US011971178B2

(12) United States Patent
Choi et al.

(10) Patent No.: US 11,971,178 B2
(45) Date of Patent: Apr. 30, 2024

(54) INDOOR UNIT OF AN AIR CONDITIONER

(71) Applicant: LG ELECTRONICS INC., Seoul (KR)

(72) Inventors: Sunggyu Choi, Seoul (KR); Kangyoung Kim, Seoul (KR); Junseok Bae, Seoul (KR); Seongkuk Mun, Seoul (KR); Heejun Cheon, Seoul (KR); Nahee Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 898 days.

(21) Appl. No.: 16/981,248

(22) PCT Filed: Mar. 15, 2019

(86) PCT No.: PCT/KR2019/003020
§ 371 (c)(1),
(2) Date: Sep. 15, 2020

(87) PCT Pub. No.: WO2019/177413
PCT Pub. Date: Sep. 19, 2019

(65) Prior Publication Data

US 2021/0025599 A1 Jan. 28, 2021

(30) Foreign Application Priority Data

Mar. 16, 2018 (KR) ..... 10-2018-0030777
Mar. 4, 2019 (KR) ..... 10-2019-0024951

(51) Int. Cl.
*F24F 1/00* (2019.01)
*F24F 1/0011* (2019.01)
(Continued)

(52) U.S. Cl.
CPC ..... *F24F 1/0011* (2013.01); *F24F 1/005* (2019.02); *F24F 1/0087* (2019.02); *F24F 8/80* (2021.01)

(58) Field of Classification Search
CPC ..... F24F 1/0011; F24F 1/0087; F24F 1/005; F24F 8/80
(Continued)

(56) References Cited

U.S. PATENT DOCUMENTS 5,351,442 A 10/1994 Gingras
11,454,408 B2 * 9/2022 Kim ..... B01D 46/0027
(Continued)

FOREIGN PATENT DOCUMENTS

CN 1247265 A 3/2000
CN 2432826 Y 6/2001
(Continued)

OTHER PUBLICATIONS

Office Action of Chinese Patent Office in Appl'n No. 202210093269.3, dated Jan. 28, 2023.
(Continued)

*Primary Examiner* — Charles S Bushey
(74) *Attorney, Agent, or Firm* — Bryan Cave Leighton Paisner LLP

(57) ABSTRACT

An indoor unit of an air conditioner includes a cabinet assembly; a door assembly disposed at a front of the cabinet assembly to cover the front of the cabinet assembly; a fixed plate fixed to the cabinet assembly and disposed between the door assembly and the cabinet assembly; and a door assembly moving part disposed between the door assembly and the fixed plate to move the door assembly in a left-right direction with respect to the cabinet assembly. When seen from the front of the cabinet assembly, the fixed plate is fixed eccentric in a direction where the door assembly moves such
(Continued)

that when the door assembly moves, a center line of the door assembly remains within a left-right width of the fixed plate.

20 Claims, 23 Drawing Sheets

(51) Int. Cl.
*F24F 1/005* (2019.01)
*F24F 1/0087* (2019.01)
*F24F 8/80* (2021.01)

(58) Field of Classification Search
USPC ..... 261/72.1, 74
See application file for complete search history.

(56) References Cited

U.S. PATENT DOCUMENTS

| | | | | |
|---|---|---|---|---|
| 2005/0193762 | A1 | 9/2005 | Bae | |
| 2009/0181611 | A1 | 7/2009 | Hollender et al. | |
| 2011/0083461 | A1 | 4/2011 | Kim | |
| 2017/0097162 | A1* | 4/2017 | Shin | F24F 1/0029 |
| 2017/0176026 | A1 | 6/2017 | Lee et al. | |
| 2021/0010706 | A1* | 1/2021 | Gyeong | F24F 11/50 |
| 2021/0018186 | A1* | 1/2021 | Bae | F24F 1/005 |
| 2021/0025601 | A1* | 1/2021 | Mun | F24F 13/1426 |
| 2021/0041134 | A1* | 2/2021 | Mun | F24F 1/0011 |
| 2021/0088075 | A1* | 3/2021 | Bae | F24F 1/0087 |

FOREIGN PATENT DOCUMENTS

| | | | |
|---|---|---|---|
| CN | 1955583 | A | 5/2007 |
| CN | 1955584 | A | 5/2007 |
| CN | 101135473 | A | 3/2008 |
| CN | 201206883 | Y | 3/2009 |
| CN | 201439968 | U | 1/2010 |
| CN | 101793426 | A | 8/2010 |
| CN | 102778014 | A | 11/2012 |
| CN | 102907931 | A | 2/2013 |
| CN | 102954534 | A | 3/2013 |
| CN | 102997339 | A | 3/2013 |
| CN | 103807991 | A | 5/2014 |
| CN | 203748961 | U | 8/2014 |
| CN | 104197414 | A | 12/2014 |
| CN | 204084627 | U | 1/2015 |
| CN | 204354764 | U | 5/2015 |
| CN | 204370956 | U | 6/2015 |
| CN | 204587836 | U | 8/2015 |
| CN | 104896586 | A | 9/2015 |
| CN | 204629755 | U | 9/2015 |
| CN | 105091102 | A | 11/2015 |
| CN | 105180402 | A | 12/2015 |
| CN | 105423525 | A | 3/2016 |
| CN | 205592282 | U | 9/2016 |
| CN | 106016666 | A | 10/2016 |
| CN | 205717526 | U | 11/2016 |
| CN | 106196308 | A | 12/2016 |
| CN | 205860408 | U | 1/2017 |
| CN | 106594878 | A | 4/2017 |
| CN | 206073266 | U | 4/2017 |
| CN | 106642625 | A | 5/2017 |
| CN | 206231946 | U | 6/2017 |
| CN | 106996632 | A | 8/2017 |
| CN | 107084442 | A | 8/2017 |
| CN | 107525147 | A | 12/2017 |
| EP | 1 571 401 | A2 | 9/2005 |
| JP | S59-210234 | A | 11/1984 |
| JP | H09-178259 | A | 7/1997 |
| JP | 1096534 | A | 4/1998 |
| JP | 2000-308550 | A | 11/2000 |
| JP | 2006-226069 | A | 8/2006 |
| KR | 10-2007-0044744 | A | 4/2007 |
| KR | 10-2007-0047102 | A | 5/2007 |
| KR | 10-0749765 | B1 | 8/2007 |
| KR | 10-0768168 | B1 | 10/2007 |
| KR | 10-0805365 | B1 | 2/2008 |
| KR | 20-2009-0000506 | U | 1/2009 |
| KR | 10-2009-0084474 | A | 8/2009 |
| KR | 10-2014-0067310 | A | 6/2010 |
| KR | 10-2011-0040037 | A | 4/2011 |
| KR | 10-2014-0052035 | A | 5/2014 |
| KR | 10-2016-0006562 | A | 1/2016 |
| KR | 10-2017-0061137 | A | 6/2017 |
| WO | 2014/041891 | A1 | 3/2014 |

OTHER PUBLICATIONS

Office Action of Chinese Patent Office in Appl'n No. 202210093195.3, dated Jan. 31, 2023.

Office Action of Chinese Patent Office in Appl'n No. 202210092649.5, dated Feb. 4, 2023.

Office Action of Chinese Patent Office in Appl'n No. 202210092615.6, dated Feb. 4, 2023.

* cited by examiner

【FIG. 1】
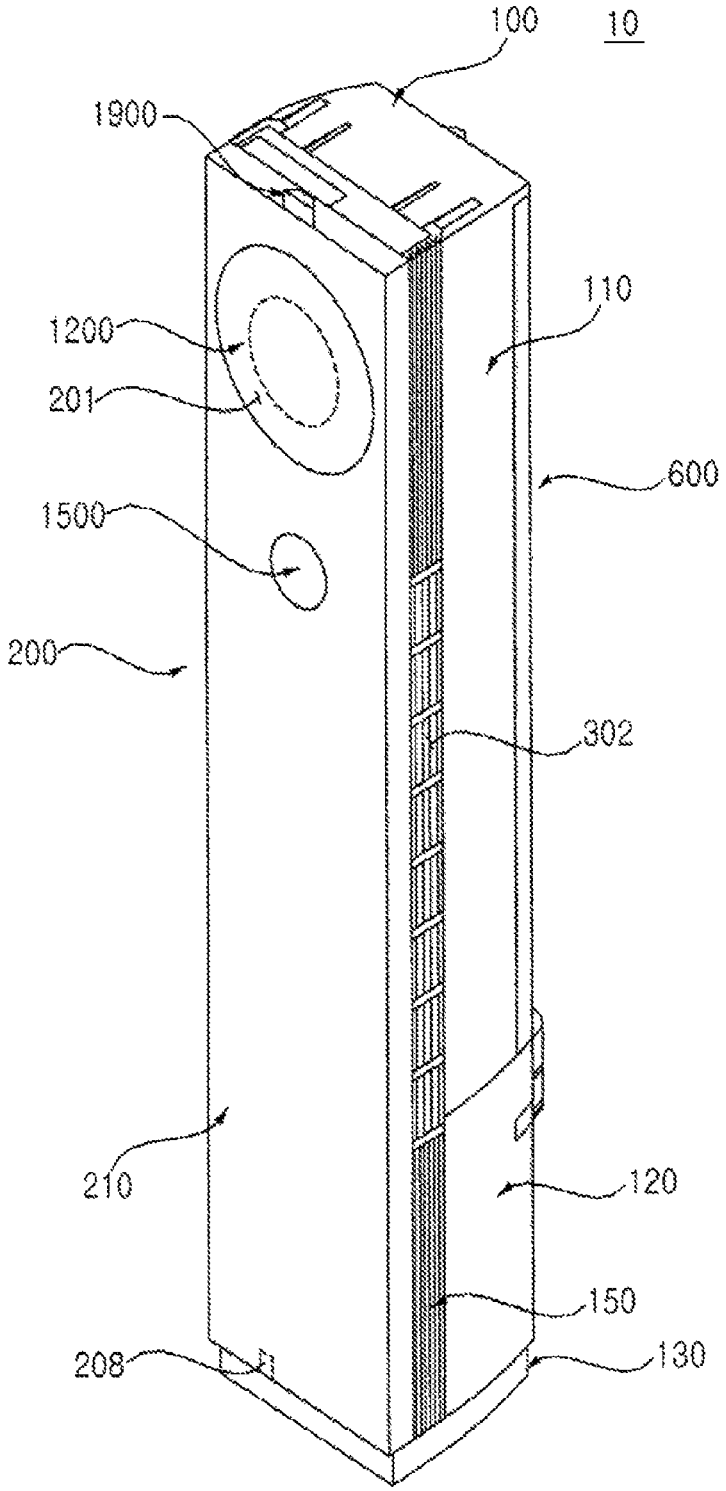

【FIG. 2】
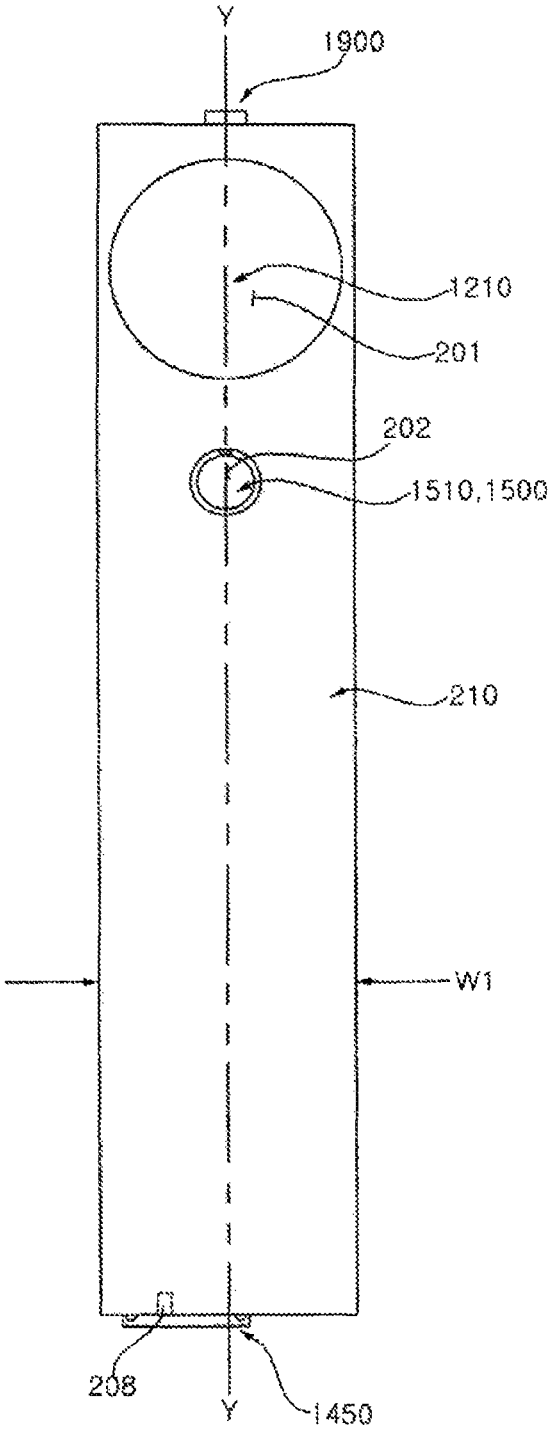

【FIG. 3】
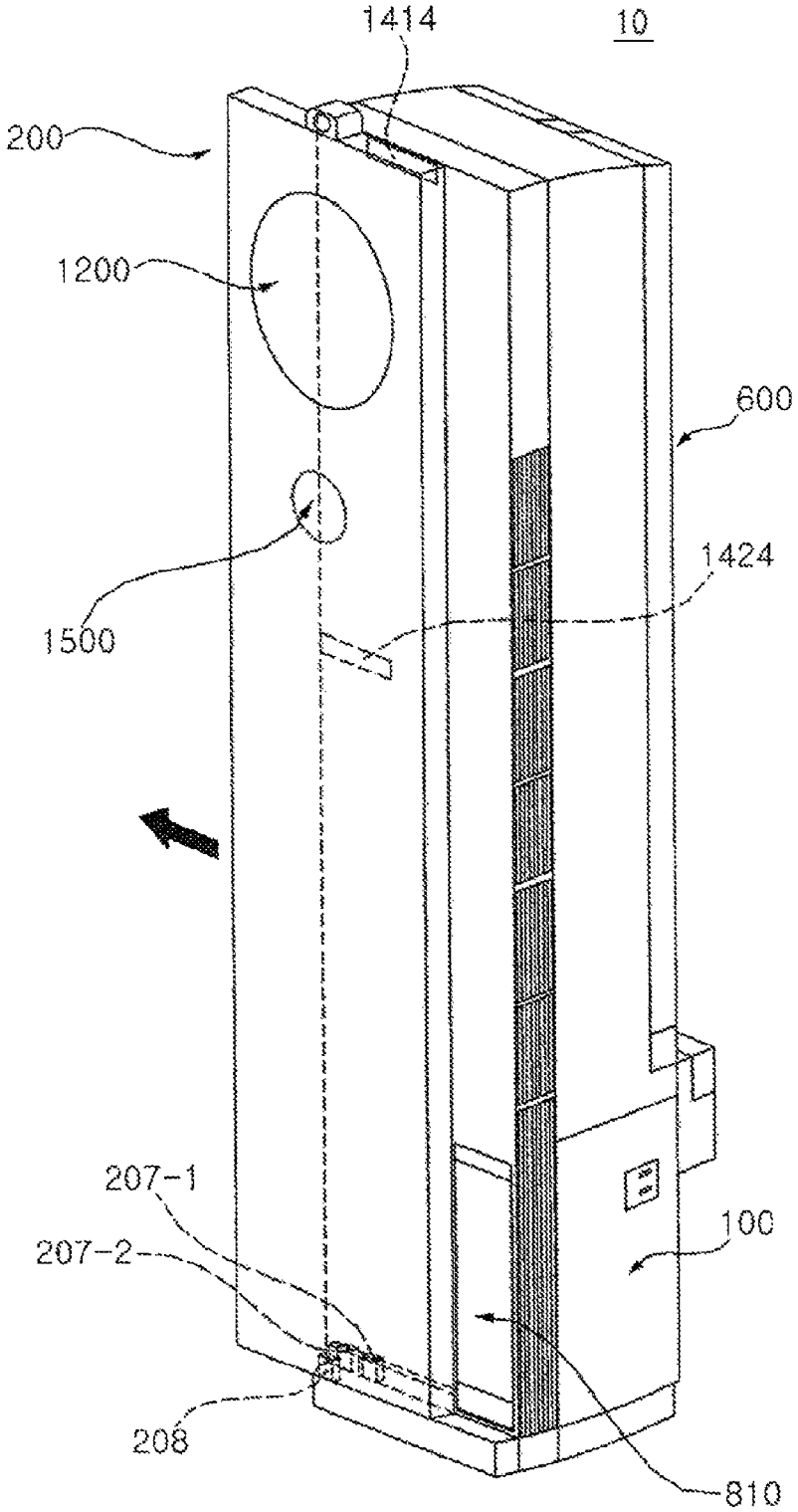

【FIG. 4】
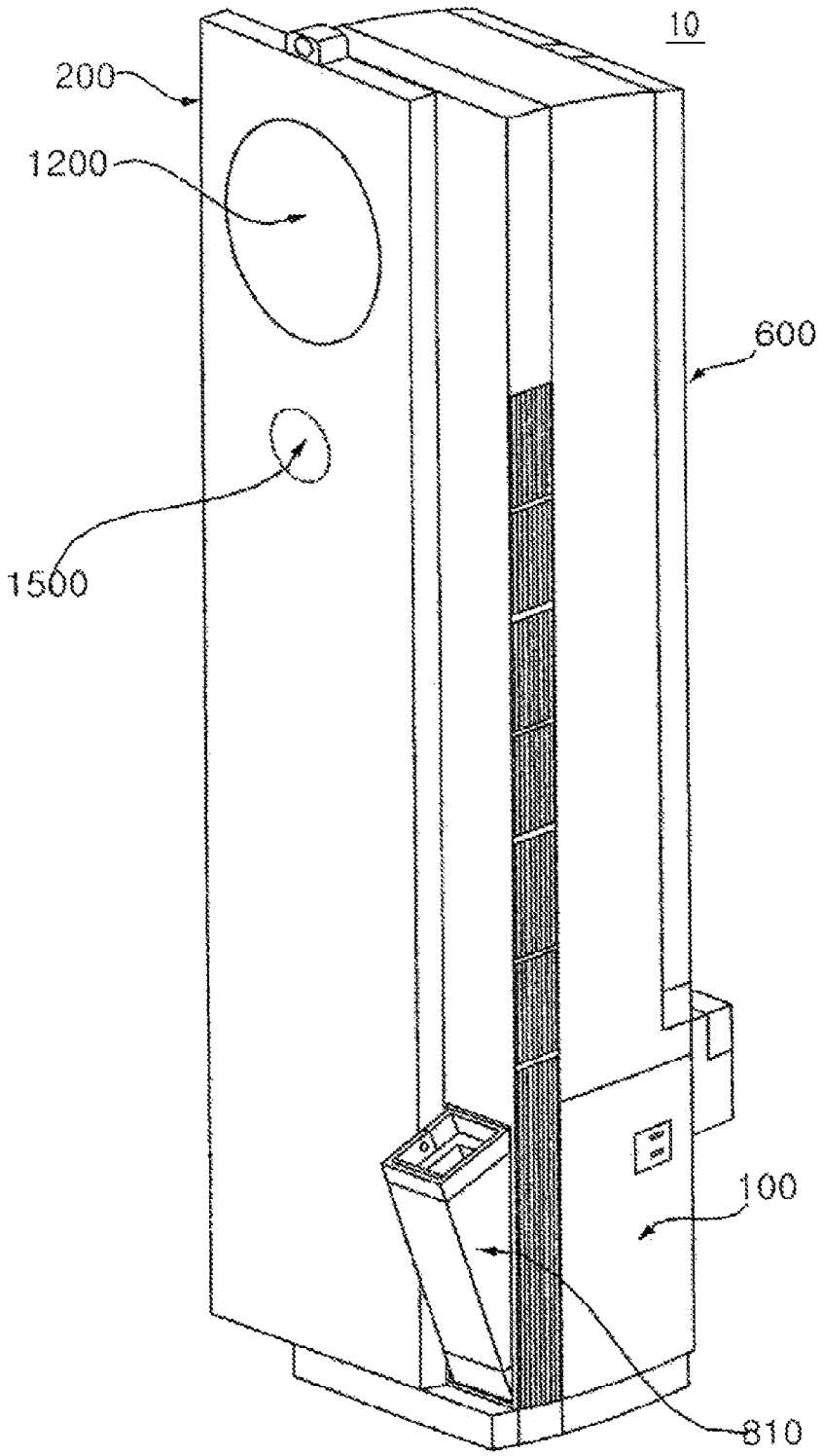

【FIG. 5】
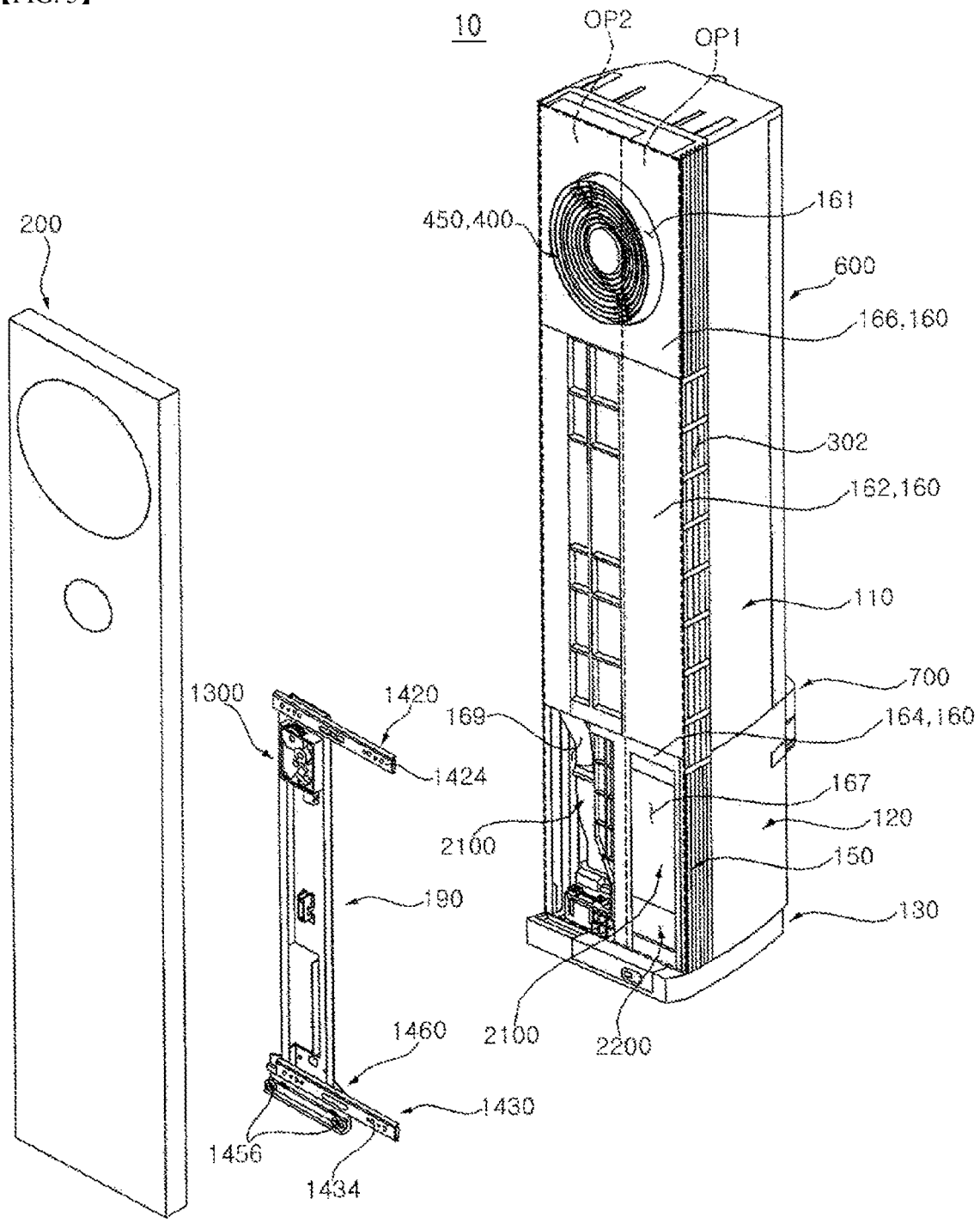

【FIG. 6】
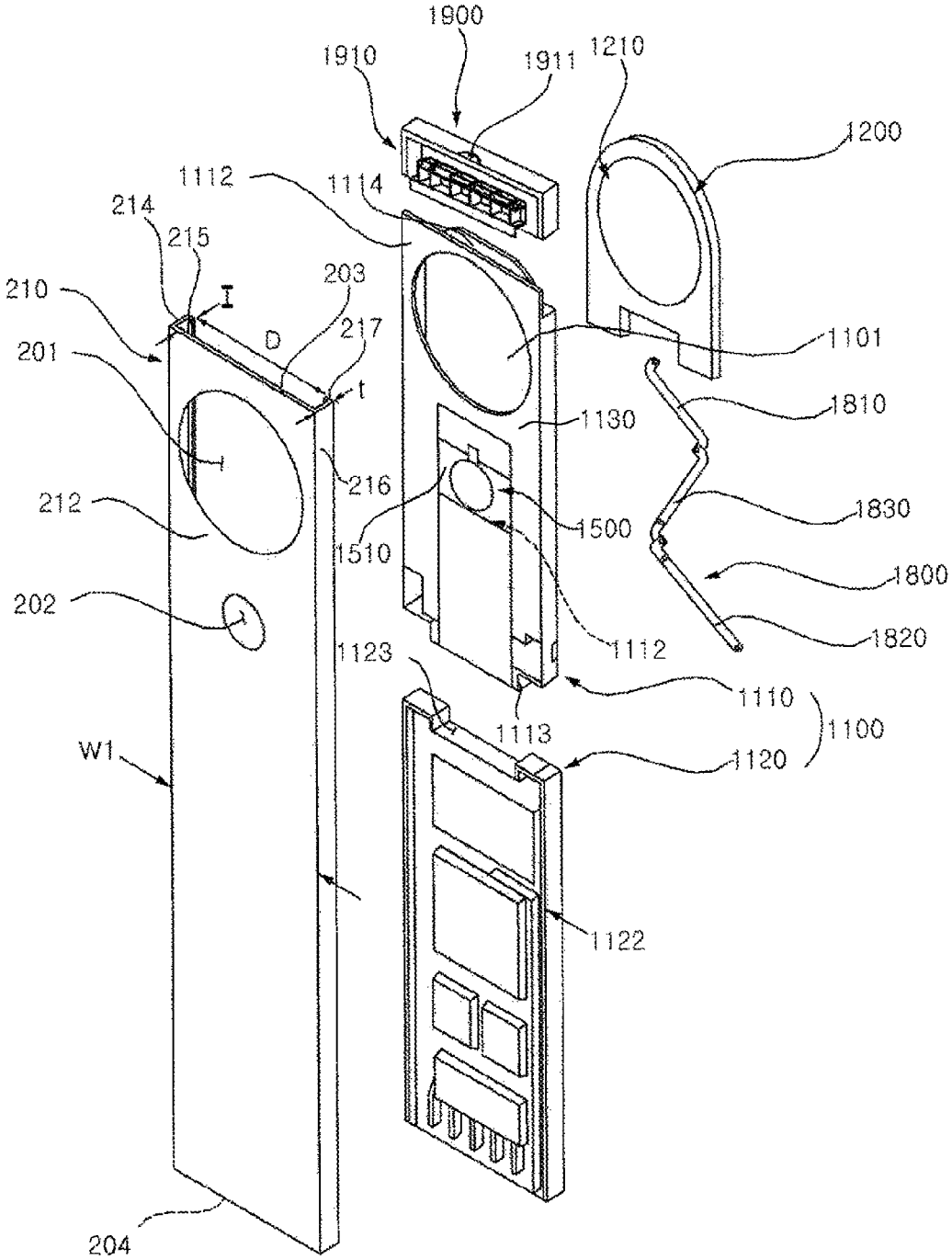

【FIG. 7】
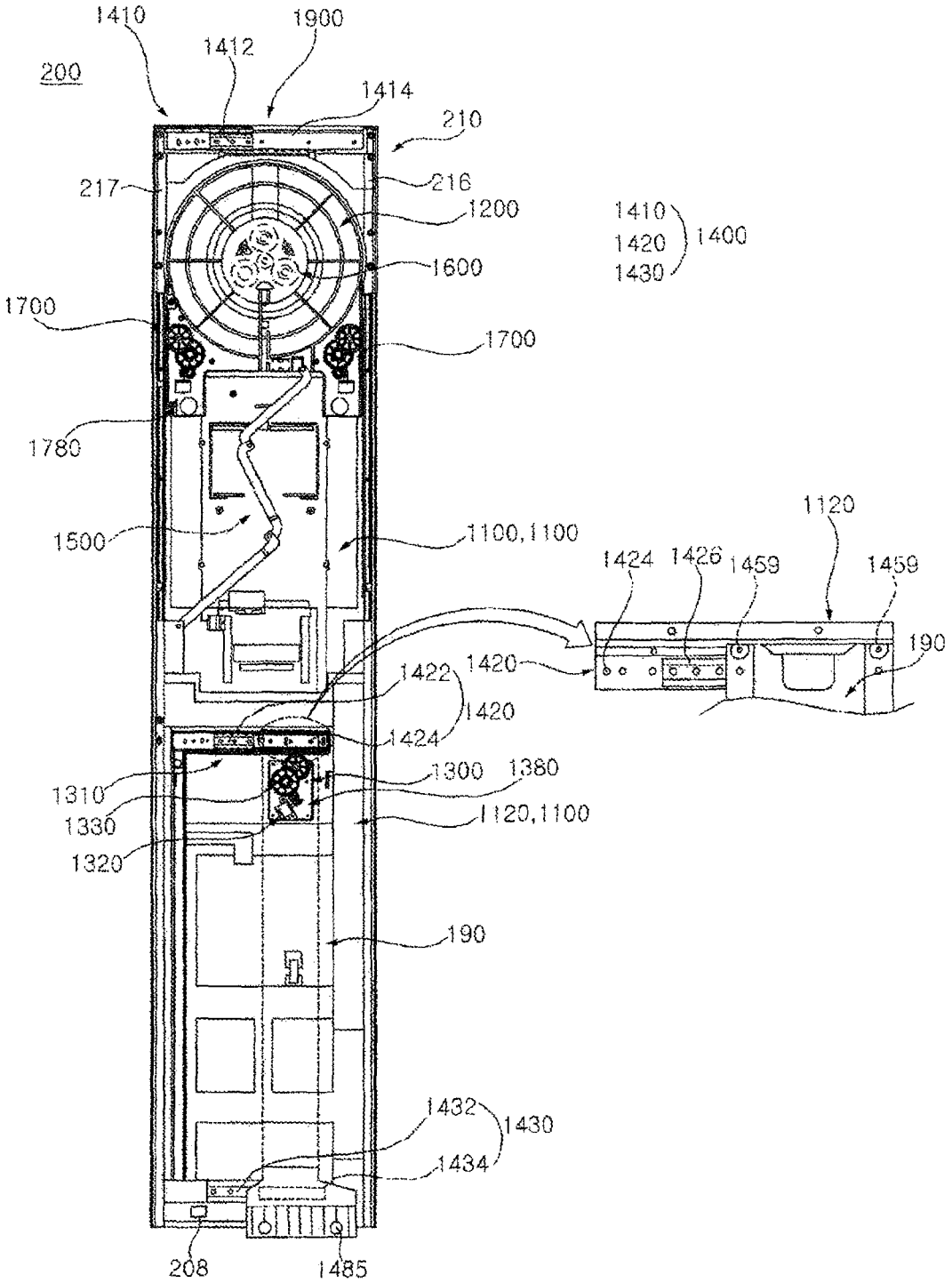

【FIG. 8】
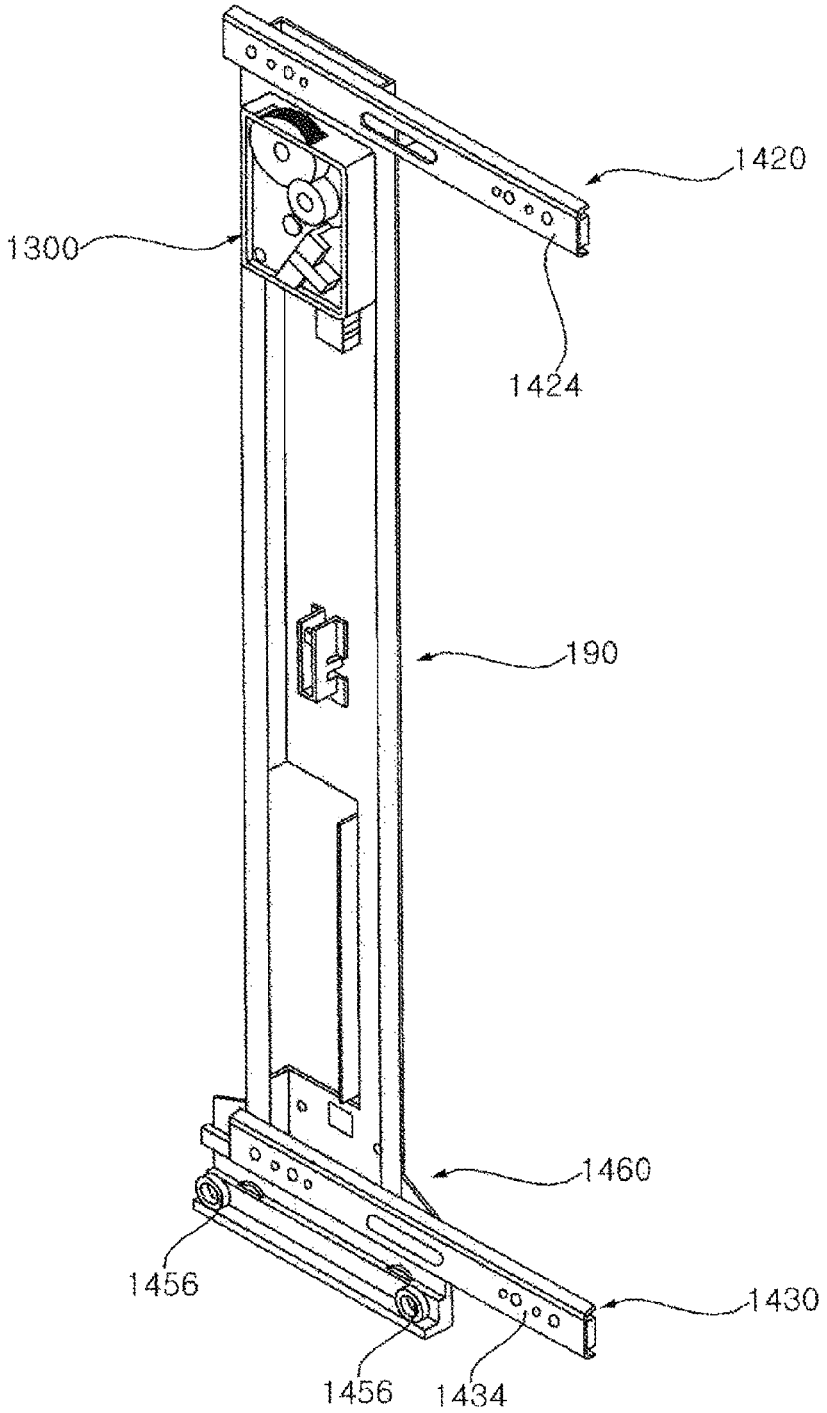

【FIG. 9】
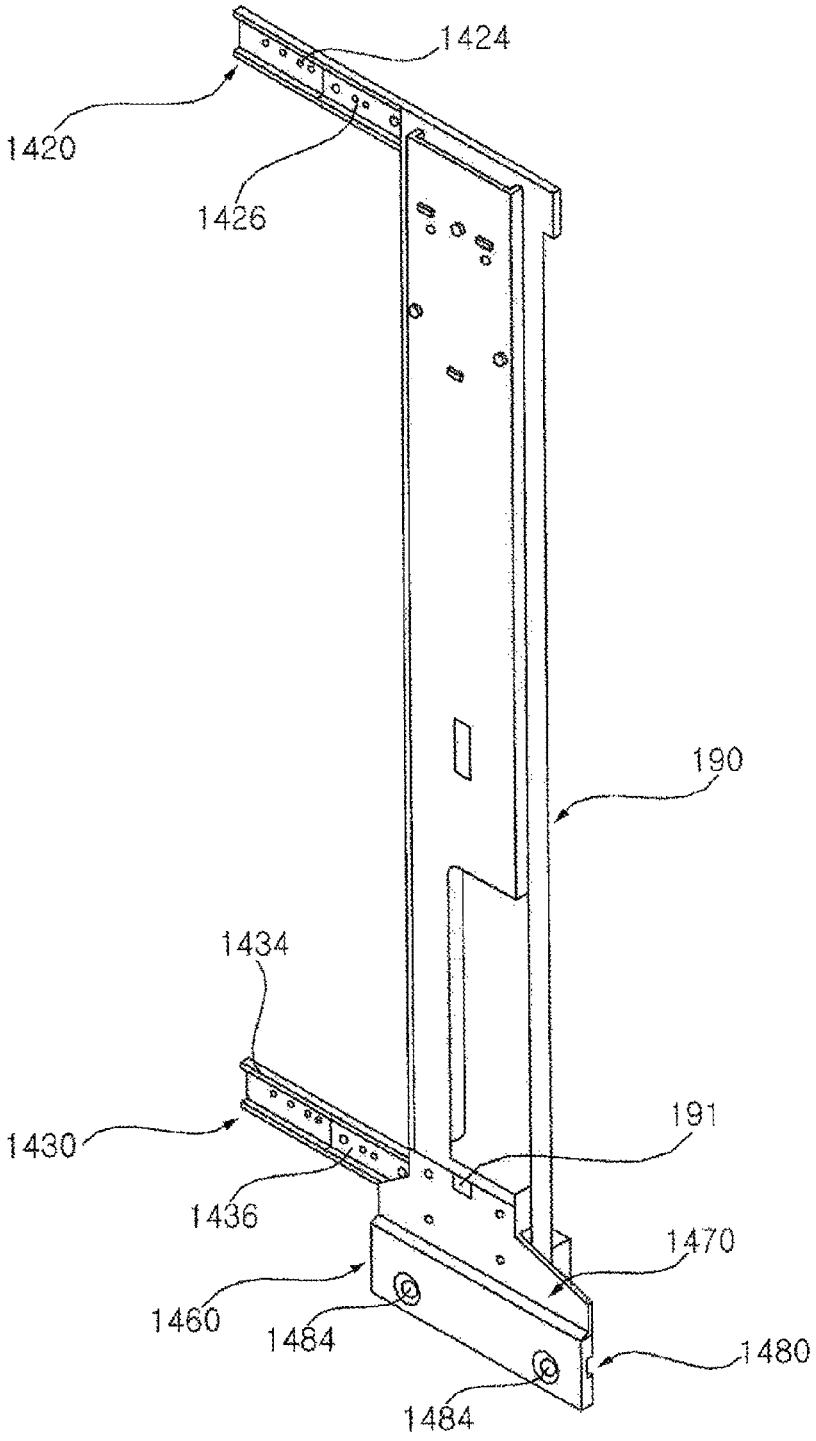

【FIG. 10】
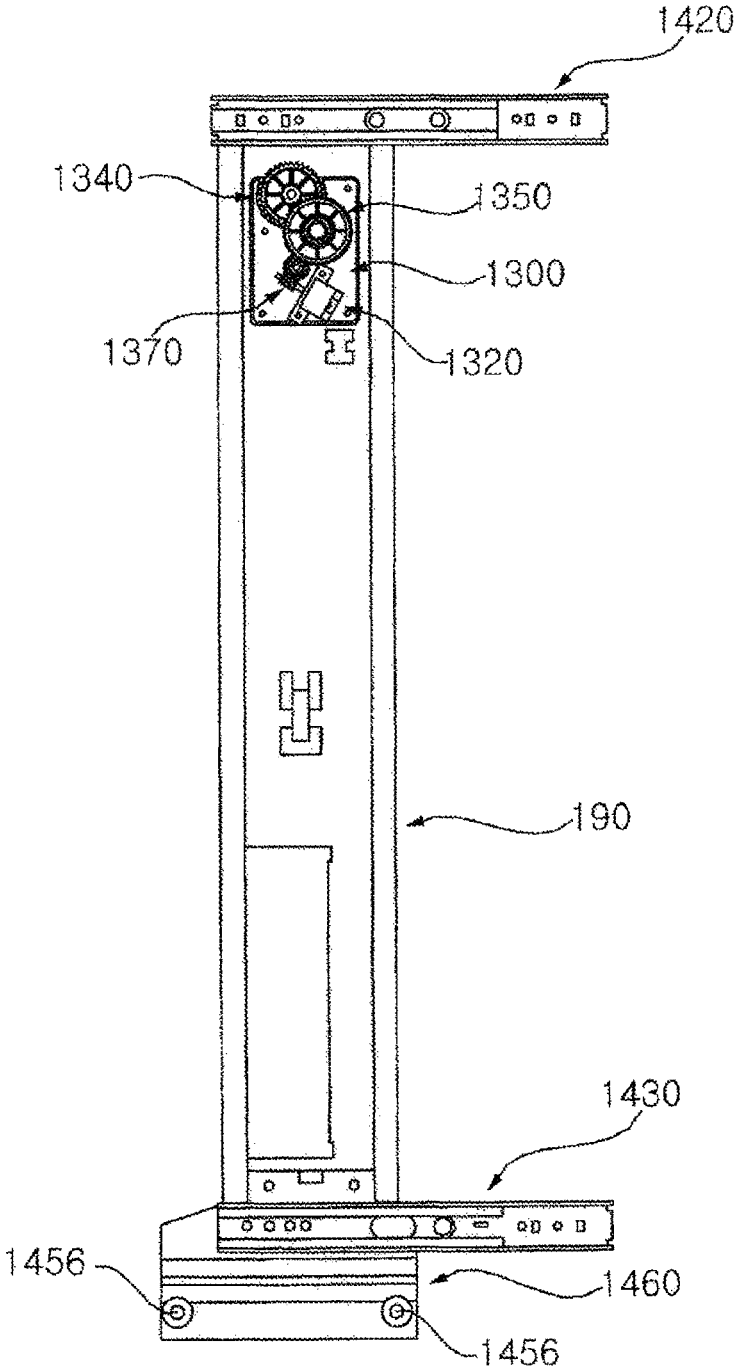

【FIG. 11】
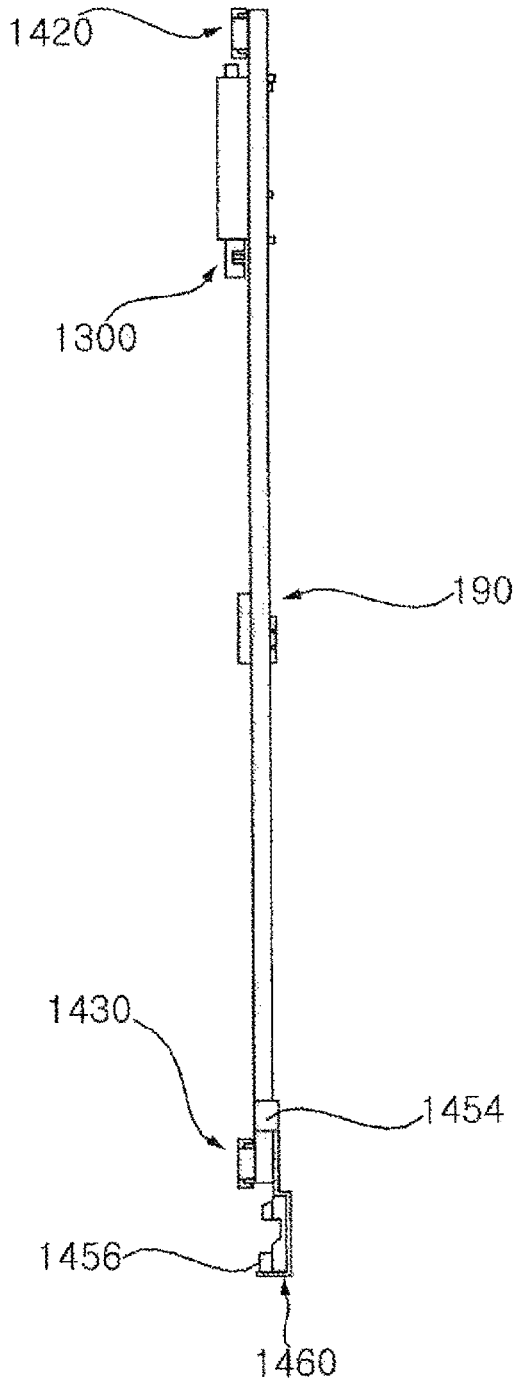

【FIG. 12】
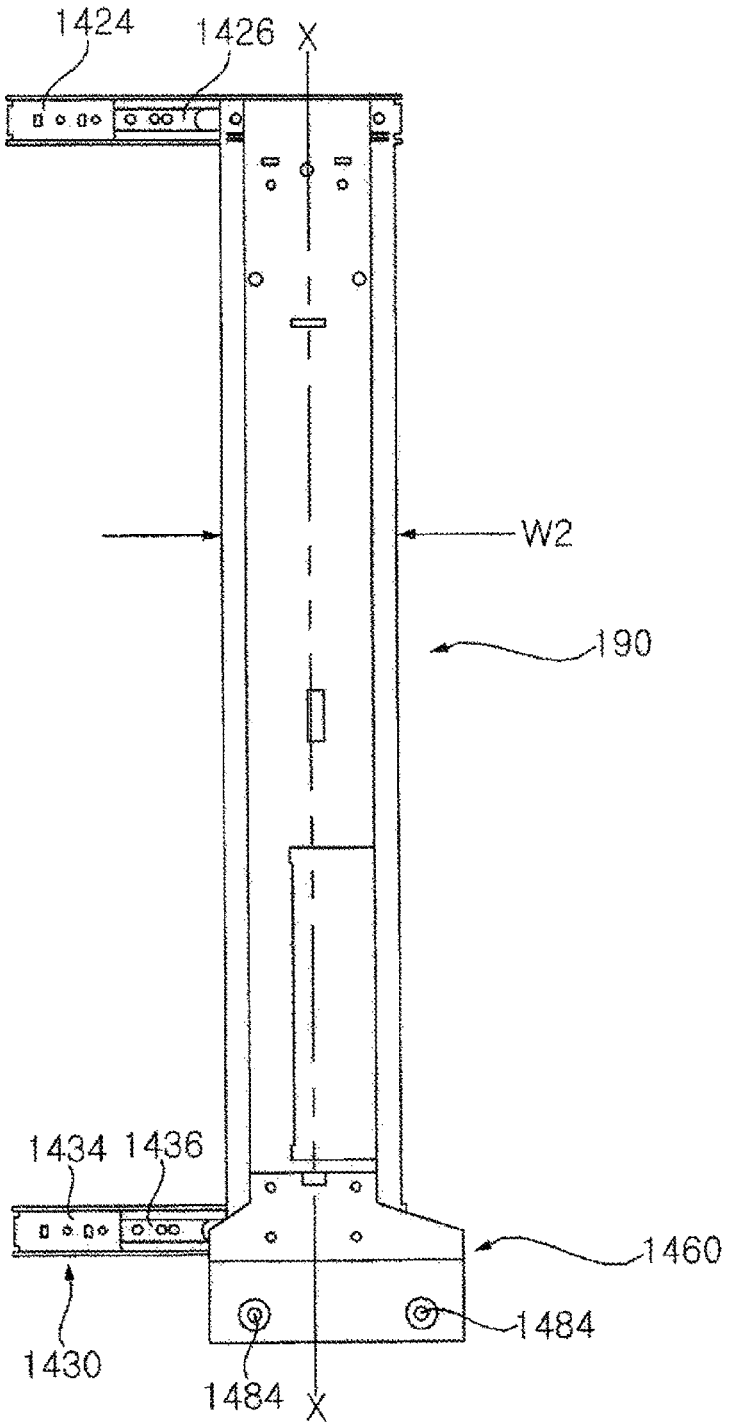

【FIG. 13】
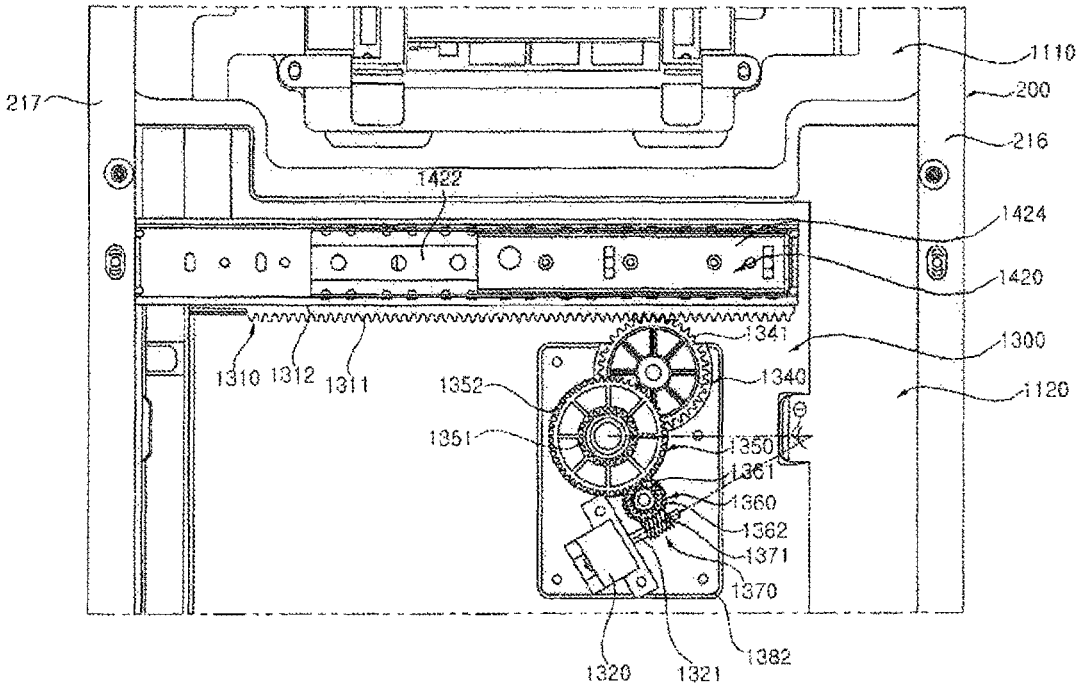

【FIG. 14】
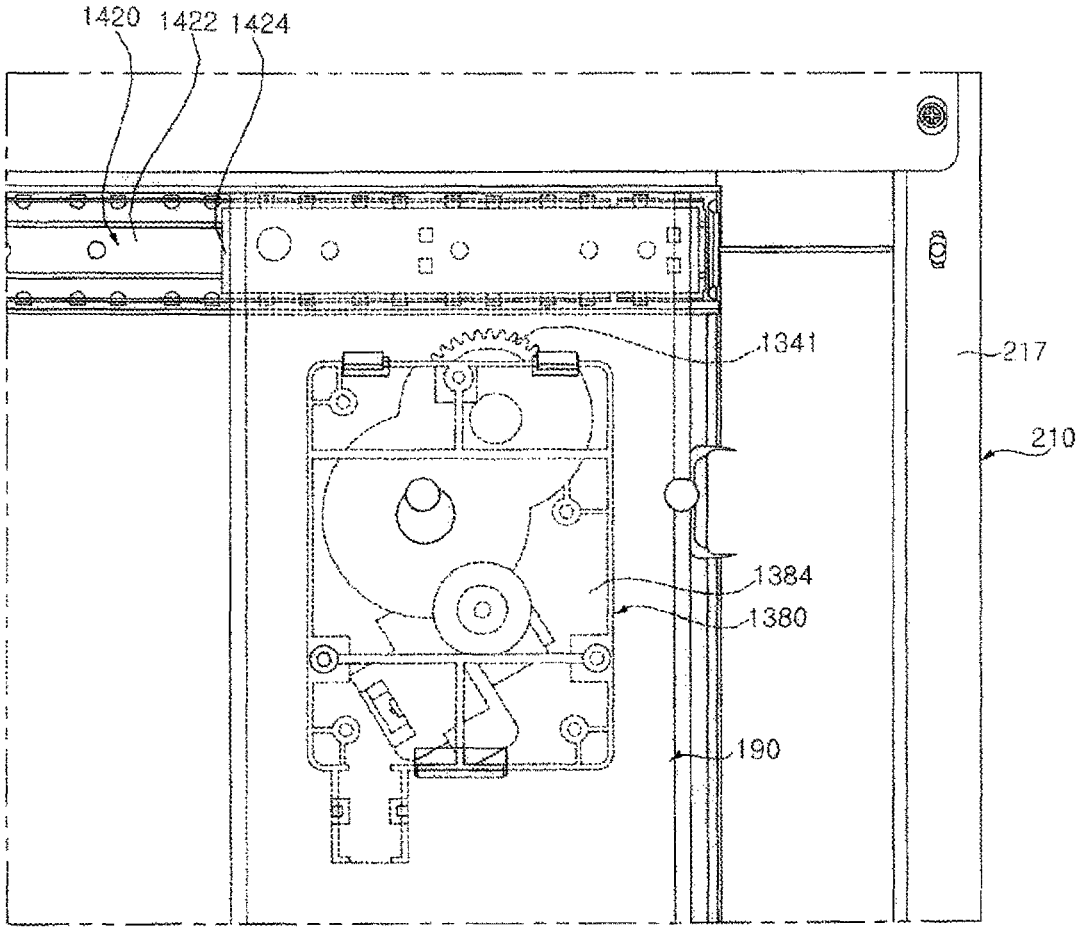

【FIG. 15】
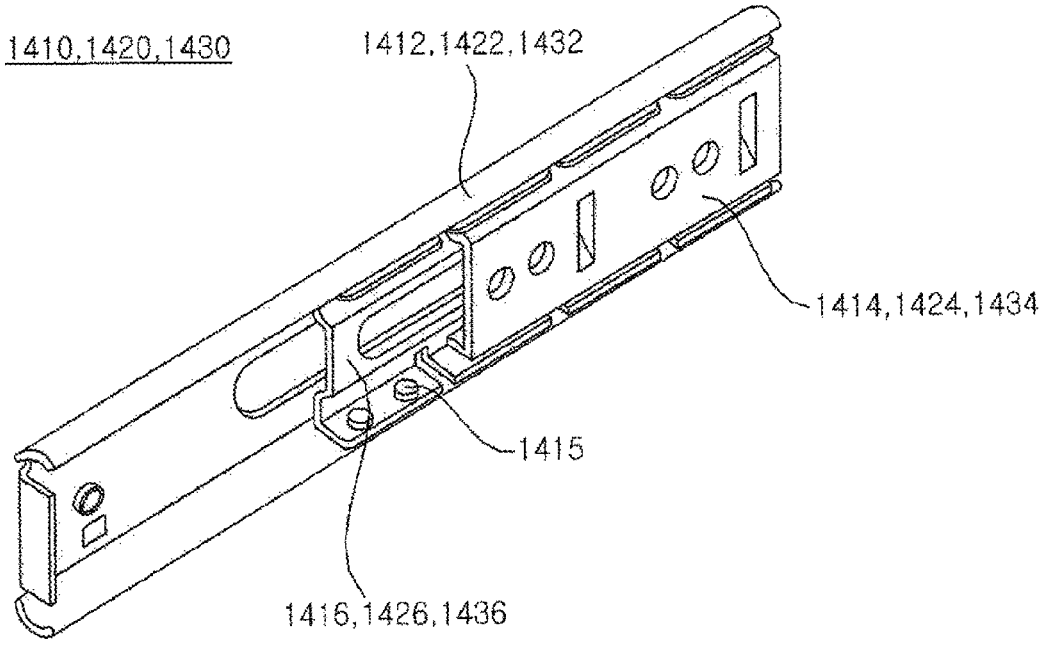

【FIG. 16】
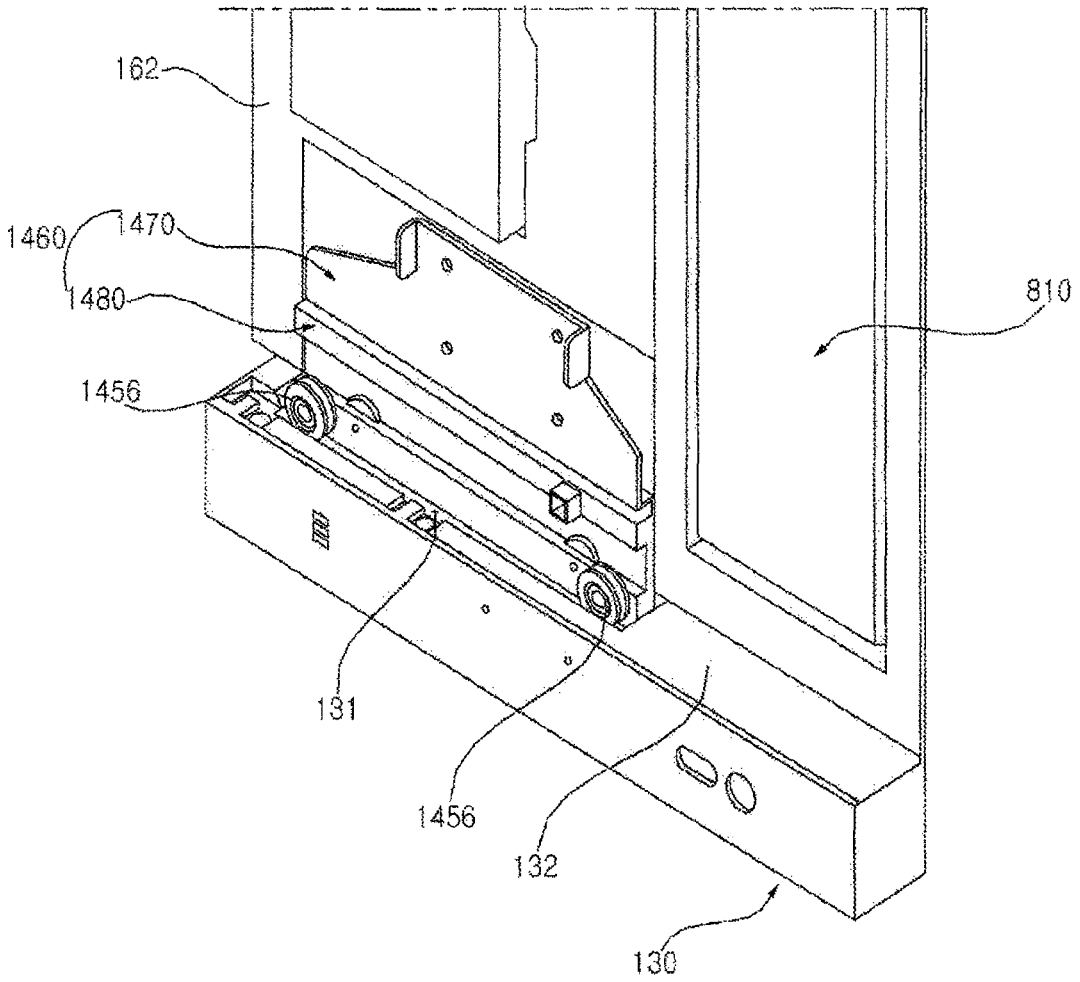

【FIG. 17】
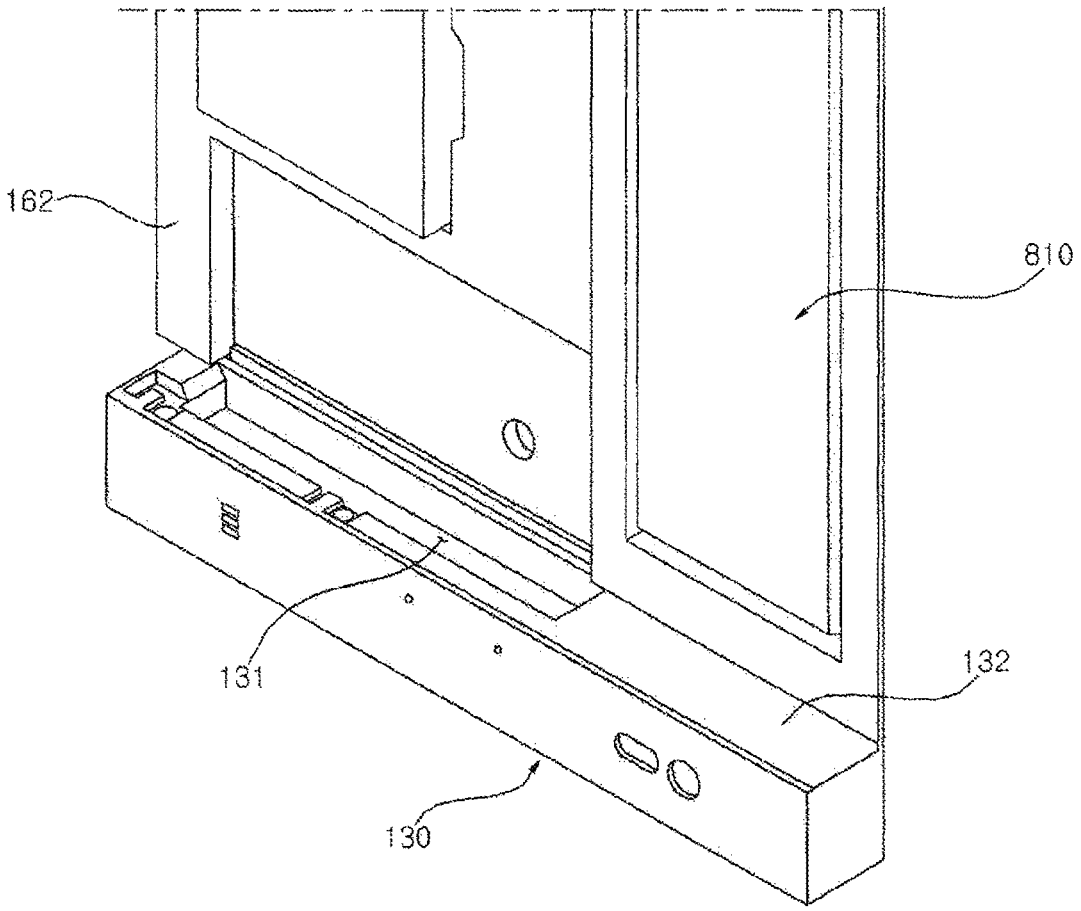

【FIG. 18】
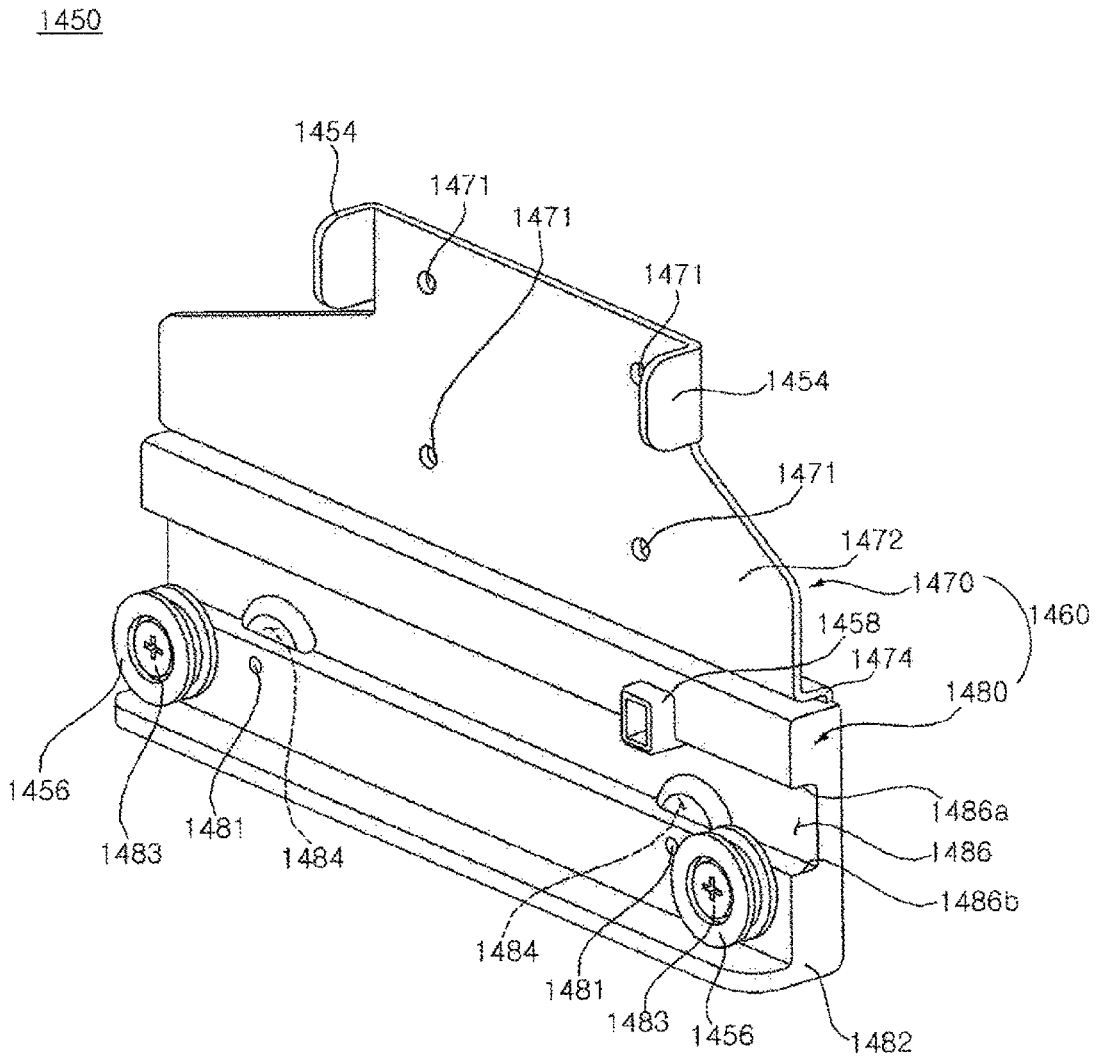

【FIG. 19】
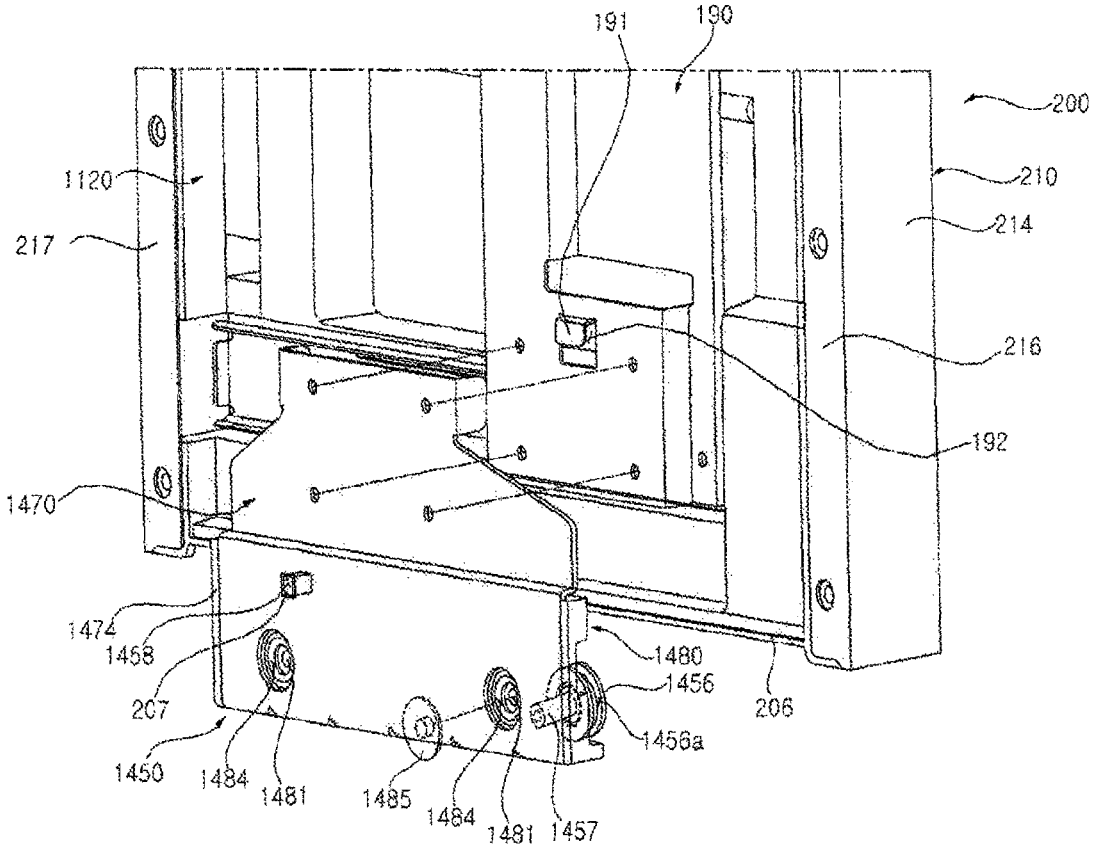

【FIG. 20】
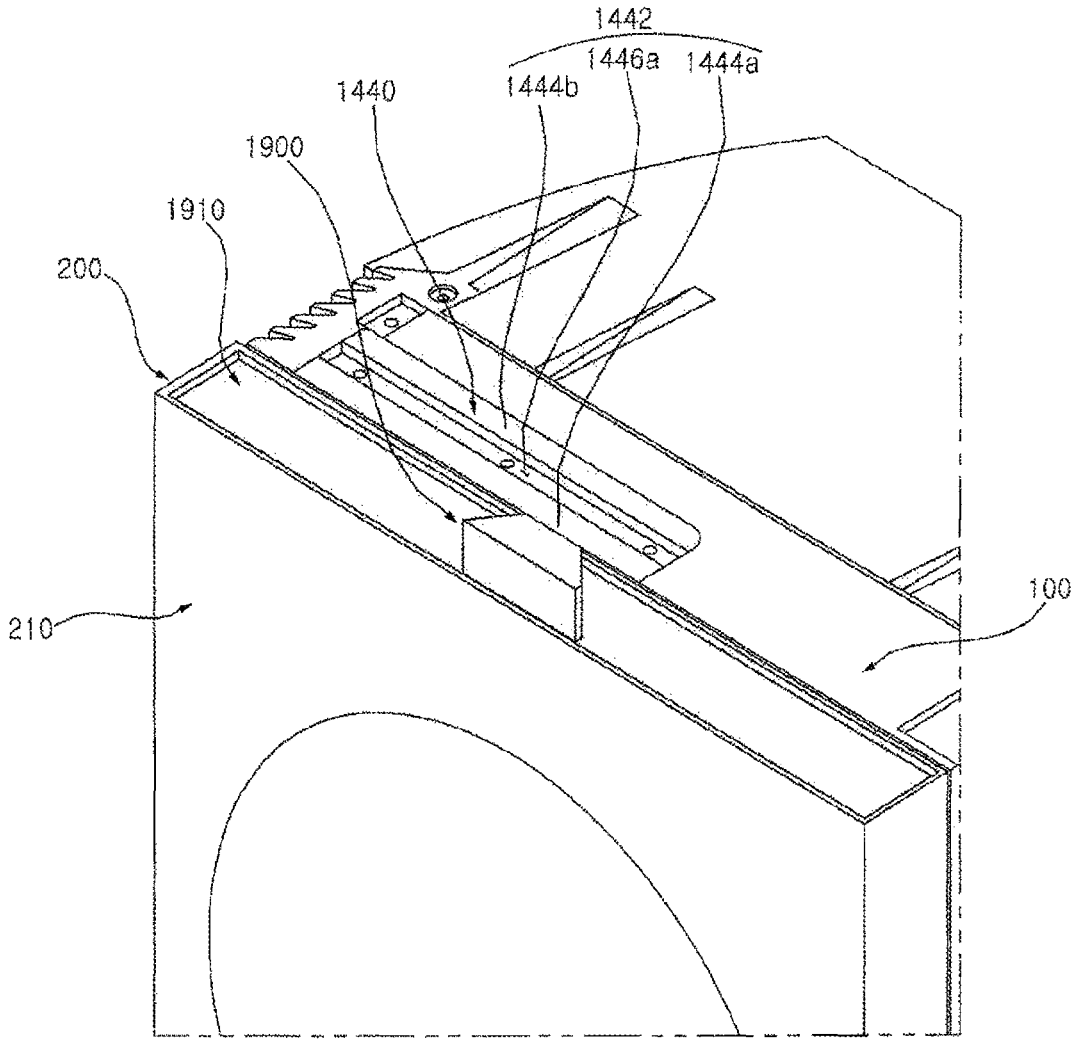

【FIG. 21】
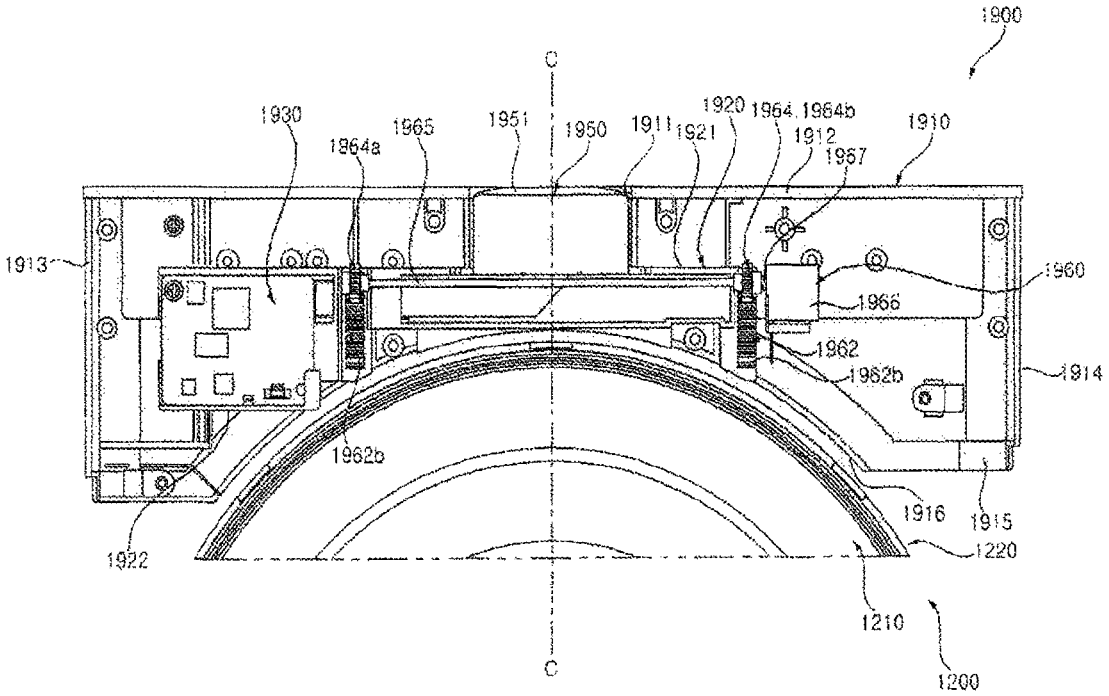
【FIG. 22】
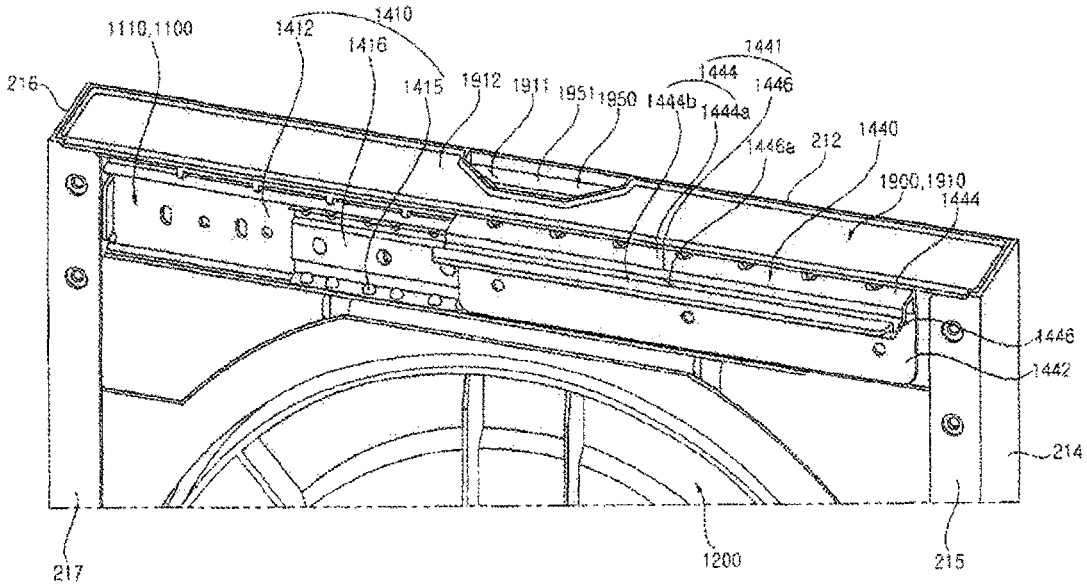

【FIG. 23】
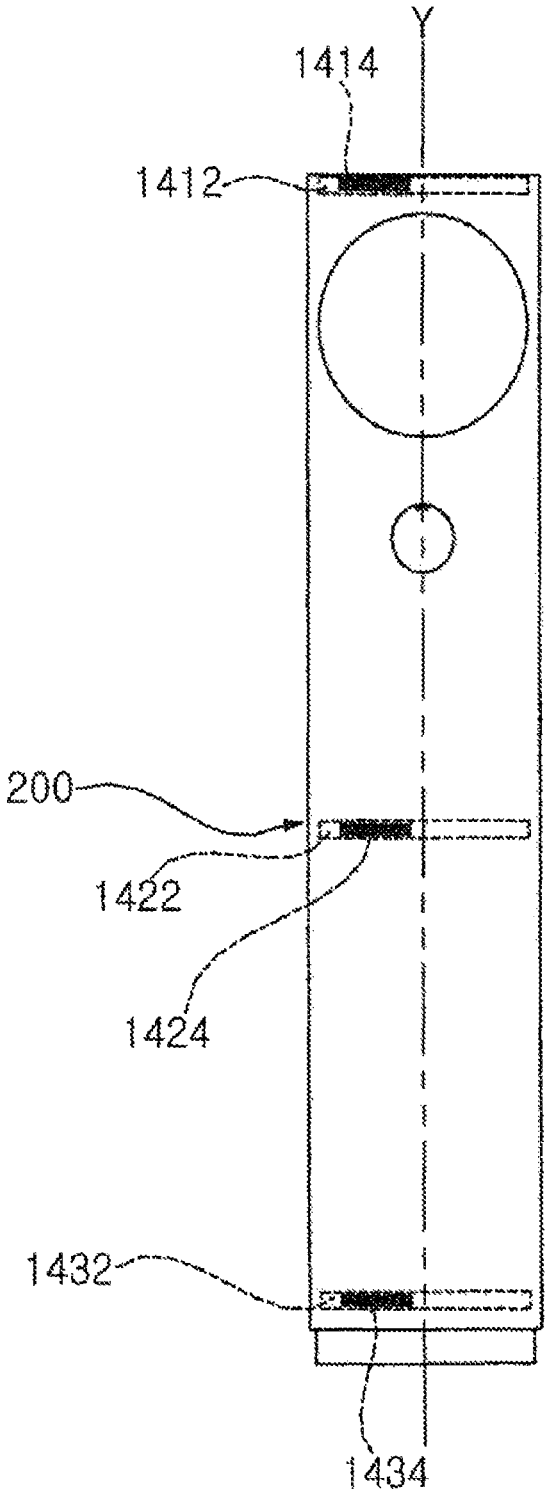

【FIG. 24】
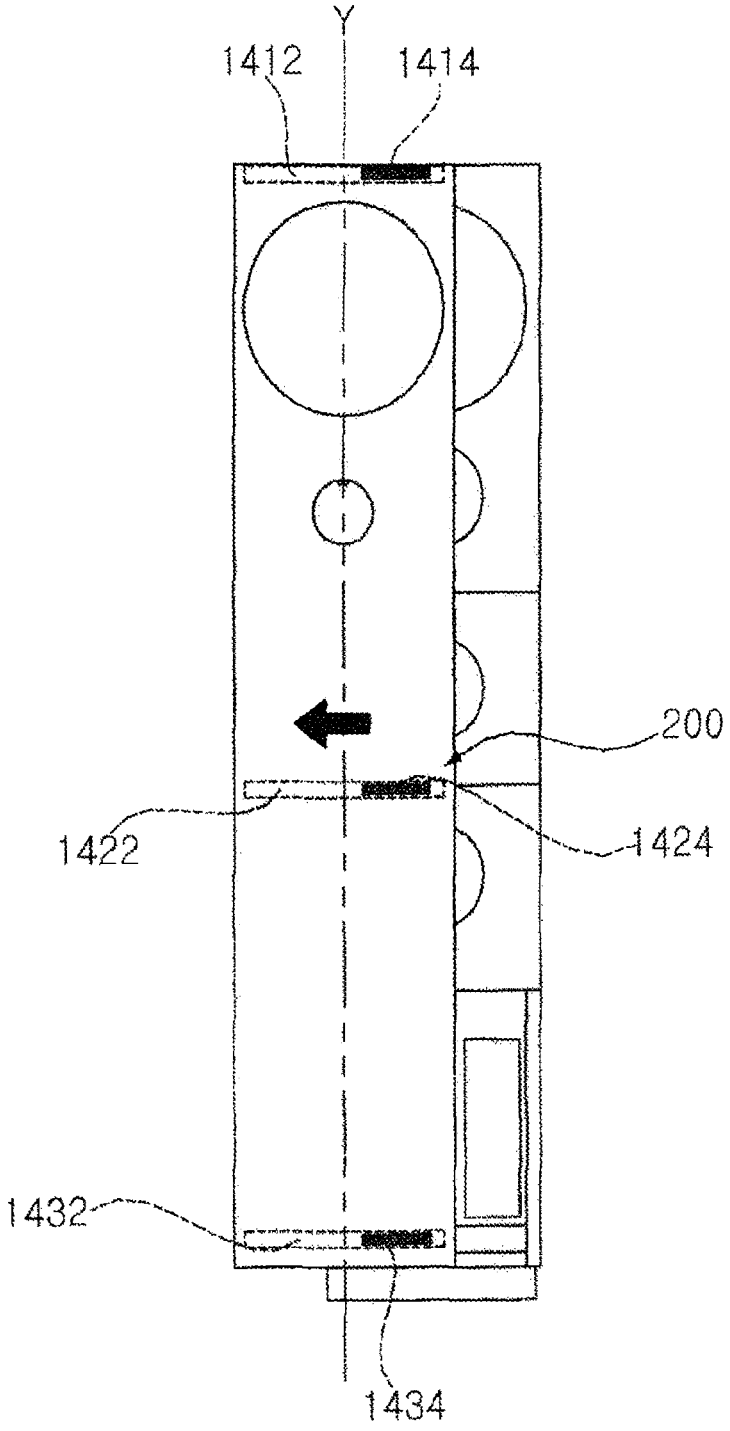

INDOOR UNIT OF AN AIR CONDITIONER

CROSS-REFERENCE TO RELATED APPLICATION

This application is a National Stage Application of International Application No. PCT/KR2019/003020, filed on Mar. 15, 2019, which claims benefit of and priority to Korean Patent Application Nos.: KR10-2018-0030777, filed on Mar. 16, 2018, and KR10-2019-0024951, filed on Mar. 4, 2019, all of which are hereby incorporated by reference in their entirety for all purposes as if fully set forth herein.

TECHNICAL FIELD

The present disclosure relates to an indoor unit of an air conditioner, and more particularly, an indoor unit for an air conditioner that enables a door assembly to slide in a left-right direction.

BACKGROUND

For split air conditioners, an indoor unit is disposed in an indoor space, and an outdoor unit is disposed in an outdoor space. Air in the indoor space can be cooled, heated or dehumidified, using refrigerants circulating in the indoor unit and the outdoor unit.

The indoor unit of the split air conditioner can be classified as a standing indoor unit that stands on the floor, a wall-mounted indoor unit that is mounted on the wall in an indoor space, a ceiling-mounted indoor unit that is installed on the ceiling in an indoor space and the like, based on methods for installation.

A structure, which is provided with a main body and a door and is configured to open an inside of a cabinet through the door, is disclosed in Korean Patent No. 10-1174030 (referred to as Prior Art 1).

In Prior Art 1, an inside of the main body is opened based on a rotation of the door. Accordingly, when the door is opened and closed, a large amount of front space is required.

A structure, where a discharge port is opened and closed based on a slide, is disclosed in Korean Patent Publication No. 10-2005-0095978 (referred to as Prior Art 2).

In case a part of a front surface of an indoor unit is slid as in Prior Art 2, there are no structural limitations. However, in case a door constituting the front surface of the indoor unit is entirely slid, eccentricity and deflection and the like may be caused due to a load of the entire door.

SUMMARY

The present disclosure is directed to an indoor unit of an air conditioner that may slide a door assembly in a left-right direction, thereby making it possible to expose a water tank.

The present disclosure is directed to an indoor unit of an air conditioner that may prevent deflection of a door assembly.

The present disclosure is directed to an indoor unit of an air conditioner that may minimize eccentricity caused by movement of a door assembly when the door assembly protrudes out of a cabinet assembly as a result of a sliding movement of the door assembly.

The present disclosure is directed to an indoor unit of an air conditioner that may firmly support a door assembly although the door assembly protrudes laterally with respect to a cabinet assembly.

The present disclosure is directed to an indoor unit of an air conditioner that may automatically move a door assembly only to the extent that a water tank is exposed.

The present disclosure is directed to an indoor unit of an air conditioner that may hide a side moving assembly behind a back surface of a door assembly.

The present disclosure is directed to an indoor unit of an air conditioner that may reduce friction when a door assembly slides.

Objectives are not limited to the above-described ones, and other objectives that have not been mentioned may be clearly understood by one having ordinary skill in the art to which the present disclosure pertains from the following descriptions.

TECHNICAL SOLUTIONS

According to the present disclosure, a side moving assembly that supports a load of a door assembly and guides movement of the door assembly may be provided, thereby making it possible to slide the door assembly in a left-right direction. On the basis of the movement of the door assembly, a water tank disposed in a cabinet may be exposed to the outside.

According to the present disclosure, a top supporter and a bottom supporter may support the door assembly and may be installed to move relative to the door assembly, thereby making it possible to prevent deflection of the door assembly capable of moving in the left-right direction.

According to the present disclosure, when the door assembly protrudes out of a cabinet assembly, as a result of a sliding movement of the door assembly, a center line (Y) of the door assembly may be disposed within a left-right width of a fixed plate, thereby making it possible to minimize eccentricity caused by the movement of the door assembly.

According to the present disclosure, although the door assembly protrudes laterally with respect to the cabinet assembly, a center of gravity of the door assembly may be placed within the left-right width of the fixed plate, thereby making it possible to firmly support the door assembly.

According to the present disclosure, a door slide module may be provided, thereby making it possible to automatically move the door assembly only to the extent that a water tank is exposed.

According to the preset disclosure, the indoor unit of an air conditioner may include: a cabinet assembly; a door assembly disposed at a front of the cabinet assembly and covering a front surface of the cabinet assembly; a fixed plate fixed to the cabinet assembly and disposed between the door assembly and the cabinet assembly; and a side moving assembly disposed between the door assembly and the fixed plate and guiding a left-right movement of the door assembly with respect to the cabinet assembly. The fixed plate may be positioned at a center with respect to a left-right width of the door assembly and positioned in a direction of movement of the door assembly with respect to a center line (Y) extending in an up-down direction, and, when the door assembly moves, the center line (Y) of the door assembly may be positioned within a left-right width of the fixed plate, thereby making it possible to place a center of gravity of the door assembly within the left-right width of the fixed plate and, as a result, to minimize eccentricity caused by movement of the door assembly.

The left-right width of the fixed plate may be less than half the left-right width of the door assembly, thereby making it possible to minimize moment that is caused as the center of gravity of the door assembly becomes far from the fixed plate.

When the door assembly moves, the center line (Y) of the door assembly may be disposed at a center of the left-right width of the fixed plate, thereby making it possible to place the center of gravity of the door assembly at the center of the fixed plate.

The side moving assembly may include: a first rail extending in a left-right direction; a second rail extending in the left-right direction and having a shorter length than the first rail; and a bearing housing disposed between the first rail and the second rail, assembled respectively to the first rail and the second rail to be able to move relative to the first rail and the second rail, and reducing friction, which is caused when the bearing housing moves relative to the first rail or the second rail, based on rolling friction. The short-length second rail may be fixed to the fixed plate, and the long-length first rail may be fixed to the door assembly, thereby making it possible to prevent the rails from being exposed when the door assembly moves.

The second rail may have a length shorter than half the left-right width of the door assembly, thereby making it possible to prevent the rails from being exposed when the door assembly moves.

The second rail may have a length the same as the left-right width of the fixed plate or shorter than the left-right width of the fixed plate, thereby preventing the center line (Y) of a door from escaping out of the fixed plate when the door assembly moves.

The side moving assembly may include: a top rail disposed between the door assembly and the cabinet assembly, disposed at an upper side of the door assembly and guiding a left-right movement of the door assembly; a bottom rail disposed between the door assembly and the fixed plate, disposed at a lower side of the door assembly and guiding a left-right movement of the door assembly; and a middle rail disposed between the door assembly and the fixed plate, disposed between the top rail and the bottom rail with respect to an up-down direction and guiding a left-right movement of the door assembly.

The indoor unit may further include: a top supporter which is hung on an upper surface of the cabinet assembly, which is fixed to the cabinet assembly and where the top rail is installed, and the top rail may include: a first rail extending in the left-right direction; a second rail extending in the left-right direction and having a shorter length than the first rail; and a bearing housing disposed between the first rail and the second rail, assembled respectively to the first rail and the second rail to be able to move relative to the first rail and the second rail, and reducing friction, which is caused when the bearing housing moves relative to the first rail or the second rail, based on rolling friction. The top supporter may include: a first fixation part hung on the upper surface of the cabinet assembly and fixed to the cabinet assembly; and a second fixation part bent and formed from the first fixation part and facing a back surface of the door assembly, wherein the first rail is fixed onto the back surface of the door assembly, and the second rail is disposed at a rear of the first rail and is fixed to the second fixation part, thereby making it possible to distribute a load of the door assembly to the top supporter.

The indoor unit of an air conditioner may further include: a bottom supporter which is disposed at a rear of the door assembly, which is fixed onto the fixed plate, and at which a lower end of the door assembly is hung, and the bottom supporter may include: a bottom supporter body assembled to the fixed plate; and a bottom wheel rotatably assembled to the bottom supporter body, supporting the door assembly and rotating when the door assembly moves, thereby making it possible to distribute the load of the door assembly to the bottom supporter.

The bottom supporter body may include: a supporter plate assembled to the fixed plate and disposed at the rear of the door assembly; and a supporter body which is coupled to the supporter plate and where the bottom wheel is rotatably installed, wherein the bottom wheel is disposed further downward than the door assembly and supports a lower end of the door assembly, thereby making it possible to firmly support the load of the door assembly. Further, the bottom wheel may support the lower end of the door assembly, thereby making it possible to suppress moment generated in a forward direction of the door assembly.

The cabinet assembly may further include a base disposed on the ground and disposed further downward than the lower end of the door assembly, and the base may include a supporter groove that is concaved from an upper side to a lower side. A lower end of the supporter body may be inserted into the supporter groove, thereby making it possible to prevent the bottom supporter from being exposed to a user.

The indoor unit may further include: a rack disposed at the door assembly and extending in the left-right direction; a gear assembly disposed at the fixed plate, engaged with the rack and configured to move the rack when rotating; and a gear driving motor disposed at the fixed plate and configured to supply a driving force to the gear assembly, thereby making it possible to automatically slide the door assembly on the basis of operation of the gear driving motor.

The side moving assembly may include: a top rail disposed between the door assembly and the cabinet assembly, disposed at an upper side of the door assembly and guiding a left-right movement of the door assembly; a bottom rail disposed between the door assembly and the fixed plate, disposed at a lower side of the door assembly and guiding a left-right movement of the door assembly; and a middle rail disposed between the door assembly and the fixed plate, disposed between the top rail and the bottom rail with respect to the up-down direction and guiding a left-right movement of the door assembly. The rack may be disposed in the left-right direction along a lower side of the middle rail, and the gear assembly may be disposed at a lower side of the rack, thereby making it possible to supply a driving force for moving the door assembly, near the center of gravity of the door assembly.

The middle rack may include: a first rail extending in the left-right direction; a second rail extending in the left-right direction and having a shorter length than the first rail; and a bearing housing disposed between the first rail and the second rail, assembled respectively to the first rail and the second rail to be able to move relative to the first rail and the second rail, and reducing friction, which is caused when the bearing housing moves relative to the first rail or the second rail, based on rolling friction, wherein the first rail is fixed to the door assembly, and the second rail is fixed onto the fixed plate. The rack may protrude from a lower side of the first rack, thereby making it possible to supply a driving force for moving the door assembly, near the center of gravity of the door assembly.

The gear assembly may include a worm gear coupled to the gear driving motor and configured to rotate, and a motor shaft of the gear driving motor may be disposed to pass through the worm gear, thereby making it possible to minimize noise in operation of the gear driving motor.

The motor shaft of the gear driving motor may form a contained angle (θ) with respect to a horizontal direction, and the contained angle (θ) may be between greater than 0 degrees and less than 90 degrees with respect to the horizontal direction, thereby making it possible to suppress movement of the door assembly even when an external force is applied to the door assembly in the horizontal direction.

The gear assembly may include: a first gear which is fixed to the fixed plate side, provided with a first teeth part on an outer circumferential surface thereof, and engaged with the rack through the first teeth part; a second gear including a 2-1 teeth part and a 2-2 teeth part having different radii of curvature and engaged with the first teeth part of the first gear through the 2-1 teeth part; a third gear including a 3-1 teeth part and a 3-2 teeth part having different types of teeth and engaged with the 2-2 teeth part of the second gear through the 3-1 teeth part; and a worm gear engaged with the 3-2 teeth part and connecting to the gear driving motor to rotate.

The indoor unit may further include: a gear housing which is fixed onto the fixed plate and where the first gear, the second gear, the third gear, the worm gear and the gear driving motor are stored, and a portion of the first gear may protrude out of the gear housing and the protruding portion of the first gear may be engaged with the rack, thereby making it possible to minimize exposure of the gear assembly to the outside.

ADVANTAGEOUS EFFECTS

An indoor unit of an air conditioner according to the present disclosure has one or more advantages that are described hereunder.

First, a side moving assembly that supports a load of a door assembly and guides movement of the door assembly may be provided, thereby making it possible to slide the door assembly in a left-right direction. On the basis of the movement of the door assembly, a water tank disposed in a cabinet may be exposed to the outside.

Second, a top supporter and a bottom supporter may support the door assembly and may be installed to move relative to the door assembly, thereby making it possible to prevent deflection of the door assembly capable of moving in the left-right direction.

Third, when the door assembly protrudes out of the cabinet assembly, as a result of a sliding movement of the door assembly, a center line (Y) of the door assembly may be disposed within a left-right width of a fixed plate, thereby making it possible to minimize eccentricity caused by the movement of the door assembly.

Fourth, although the door assembly protrudes laterally with respect to the cabinet assembly, a center of gravity of the door assembly may be placed within the left-right width of the fixed plate, thereby making it possible to firmly support the door assembly.

Fifth, a door slide module may be provided, thereby making it possible to automatically move the door assembly only to the extent that a water tank is exposed.

Sixth, the fixed plate may be disposed at a center with respect to a left-right width of the door assembly and may be disposed in a direction of movement of the door assembly with respect to the center line (Y) extending in an up-down direction, and, when the door assembly moves, the center line (Y) of the door assembly may be placed within the left-right width of the fixed plate, thereby making it possible to place a center of gravity of the door assembly within the left-right width of the fixed plate and, as a result, to minimize eccentricity caused by the movement of the door assembly.

Seventh, the left-right width of the fixed plate may be less than half the left-right width of the door assembly, thereby making it possible to minimize moment that is caused as the center of gravity of the door assembly becomes far from the fixed plate.

Eighth, when the door assembly moves, the center line (Y) of the door assembly may be disposed at a center of the left-right width of the fixed plate, thereby making it possible to place the center of gravity of the door assembly at the center of the fixed plate.

Ninth, a short-length second rail may be fixed to the fixed plate, and a long-length first rail may be fixed to the door assembly, thereby making it possible to prevent the rails from being exposed when the door assembly moves.

Tenth, the second rail may have a length shorter than half the left-right width of the door assembly, thereby making it possible to prevent the rails from being exposed when the door assembly moves.

Eleventh, the second rail may have a length the same as the left-right width of the fixed plate or shorter than the left-right width of the fixed plate, thereby preventing the center line (Y) of a door from escaping out of the fixed plate when the door assembly moves.

Twelfth, for the top supporter, the first rail may be fixed onto a back surface of the door assembly, and the second rail may be disposed at a rear of the first rail and may be fixed to a second fixation part, thereby making it possible to distribute a load of the door assembly to the top supporter.

Thirteenth, a bottom wheel of the bottom supporter may support the door assembly, thereby making it possible to distribute the load of the door assembly to the bottom supporter and to minimize noise and friction in operation caused by a sliding movement of the door assembly.

Fourteenth, the bottom wheel may support a lower end of the door assembly, thereby making it possible to suppress moment generated in a forward direction of the door assembly.

Fifteenth, a lower end of a supporter body may be inserted into a supporter groove, thereby making it possible to prevent the bottom supporter from being exposed to a user.

Sixteenth, the door assembly may automatically slide on the basis of operation of a gear driving motor.

Seventeenth, a gear assembly may be disposed at a lower side of a rack, thereby making it possible to supply a driving force for moving the door assembly, near the center of gravity of the door assembly.

Eighteenth, the gear assembly may include a worm gear coupled to the gear driving motor and configured to rotate, and a motor shaft of the gear driving motor may be disposed to pass through the worm gear, thereby making it possible to minimize noise in operation of the gear driving motor.

Nineteenth, the motor shaft of the gear driving motor may form a contained angle (θ) with respect to a horizontal direction, and the contained angle (θ) may be between greater than 0 degrees and less than 90 degrees with respect to the horizontal direction, thereby making it possible to suppress movement of the door assembly even when an external force is applied to the door assembly in the horizontal direction.

Twentieth, a portion of a first gear constituting the gear assembly may protrude out of a gear housing and the protruding portion of the first gear may be engaged with the rack, thereby making it possible to minimize exposure of the gear assembly to the outside.

DESCRIPTION OF DRAWINGS

FIG. 1 is a perspective view illustrating an exemplary indoor unit.

FIG. 2 is a front view illustrating a door assembly in FIG. 1.

FIG. 3 is a view illustrating an example where the door assembly in FIG. 1 is slid.

FIG. 4 is a view illustrating an example where a water tank in FIG. 3 tilts.

FIG. 5 is an exploded perspective view illustrating the door assembly, a door slide module and a cabinet assembly in FIG. 1.

FIG. 6 is an exploded perspective view illustrating the door assembly in FIG. 1.

FIG. 7 is a rear view illustrating the door assembly in FIG. 1.

FIG. 8 is a perspective view illustrating the door slide module and a fixed plate in FIG. 5.

FIG. 9 is a perspective view seen from a rear of FIG. 8.

FIG. 10 is a front view of FIG. 8.

FIG. 11 is a right-side view of FIG. 10.

FIG. 12 is a rear view of FIG. 8.

FIG. 13 is an enlarged view illustrating the door slide module in FIG. 5.

FIG. 14 is a view illustrating an example where the fixed plate in FIG. 5 is installed.

FIG. 15 is a perspective view illustrating a rail in FIG. 9.

FIG. 16 is a view illustrating an example where a bottom supporter in FIG. 5 is installed.

FIG. 17 is a perspective view illustrating a base where the bottom supporter is separated from FIG. 16.

FIG. 18 is a perspective view illustrating the bottom supporter in FIG. 16.

FIG. 19 is an exploded perspective view illustrating the bottom supporter and the fixed plate in FIG. 16.

FIG. 20 is an enlarged perspective view illustrating a top supporter in FIG. 1.

FIG. 21 is a front view illustrating an inner structure of a camera module in FIG. 1.

FIG. 22 is a perspective view illustrating the top supporter and a top rail in FIG. 20 that are assembled.

FIG. 23 is a front view illustrating an indoor unit where an exemplary side moving assembly is disposed.

FIG. 24 is a view illustrating an exemplary operation of FIG. 23.

DETAILED DESCRIPTION

Advantages and features according to the present disclosure, and a method of achieving the same may be clearly understood from the following embodiments that are described with reference to the accompanying drawings. However, the present disclosure is not intended to limit the embodiments. Rather, the present disclosure is intended to cover various modifications and is provided so that it may be thorough and complete and its scope may be fully conveyed to one having ordinary skill in the art to which the disclosure pertains. Additionally, throughout the specification, like reference numerals may denote like components.

Below, an indoor unit for an air conditioner according to the present disclosure is described with reference to the accompanying drawings.

FIG. 1 is a perspective view illustrating an exemplary indoor unit. FIG. 2 is a front view illustrating a door assembly in FIG. 1. FIG. 3 is a view illustrating an example where the door assembly in FIG. 1 is slid. FIG. 4 is a view illustrating an example where a water tank in FIG. 3 tilts. FIG. 5 is an exploded perspective view illustrating the door assembly, a door slide module and a cabinet assembly in FIG. 1. FIG. 6 is an exploded perspective view illustrating the door assembly in FIG. 1. FIG. 7 is a rear view illustrating the door assembly in FIG. 1. FIG. 8 is a perspective view illustrating the door slide module and a fixed plate in FIG. 5. FIG. 9 is a perspective view seen from a rear of FIG. 8. FIG. 10 is a front view of FIG. 8. FIG. 11 is a right-side view of FIG. 10. FIG. 12 is a rear view of FIG. 8. FIG. 13 is an enlarged view illustrating the door slide module in FIG. 5. FIG. 14 is a view illustrating an example where the fixed plate in FIG. 5 is installed. FIG. 15 is a perspective view illustrating a rail in FIG. 9. FIG. 16 is a view illustrating an example where a bottom supporter in FIG. 5 is installed. FIG. 17 is a perspective view illustrating a base where the bottom supporter is separated from FIG. 16. FIG. 18 is a perspective view illustrating the bottom supporter in FIG. 16. FIG. 19 is an exploded perspective view illustrating the bottom supporter and the fixed plate in FIG. 16. FIG. 20 is an enlarged perspective view illustrating a top supporter in FIG. 1. FIG. 21 is a front view illustrating an inner structure of a camera module in FIG. 1. FIG. 22 is a perspective view illustrating the top supporter and a top rail in FIG. 20 that are assembled. FIG. 23 is a front view illustrating an indoor unit where an exemplary side moving assembly is disposed. FIG. 24 is a view illustrating an exemplary operation of FIG. 23.

The exemplary air conditioner may include an indoor unit 10, and an outdoor unit (not illustrated) connected to the indoor unit 10 through a refrigerant pipe which allows refrigerants to circulate.

The outdoor unit may include a compressor (not illustrated) configured to compress refrigerants, an outdoor heat exchanger (not illustrated) configured to receive refrigerants from the compressor and to heat exchange with the refrigerants, an outdoor fan (not illustrated) configured to supply air to the outdoor heat exchanger, and an accumulator (not illustrated) configured to receive refrigerants discharged from the indoor unit 10 and then to supply gaseous refrigerants to the compressor.

The outdoor unit may further include a four-way valve (not illustrated) to operate the indoor unit in a cooling mode or in a heating mode. In the cooling mode, refrigerants are evaporated in the indoor unit 10 to cool air in an indoor space. In the heating mode, refrigerants are condensed in the indoor unit 10 to heat air in an indoor space.

<<Configuration of Indoor Unit>>

The indoor unit 10 may include a cabinet assembly 100, a front surface of which is open and which is provided with a suction port (not illustrated) on a rear surface thereof, a door assembly 200 assembled to the cabinet assembly 100, configured to cover the front surface of the cabinet assembly 100 and configured to open and close the front surface of the cabinet assembly 100, a fan assembly 400 disposed in the cabinet assembly 100 and configured to discharge air in the inner space to an indoor space, a heat exchange assembly disposed between the fan assembly 400 and the cabinet assembly 100 and allowing heat exchange between suctioned indoor air and refrigerants, a humidification assembly disposed at the cabinet assembly 100 and configured to supply moisture to the indoor space, a filter assembly 600 disposed at a back surface of the cabinet assembly 100 and configured to filter air flowing to the suction port, and a moving cleaner 700 moving in an up-down direction along the filter assembly 600 and configured to separate and collect foreign substances from the filter assembly 600.

The indoor unit 10 may include the suction port disposed on the back surface with respect to the cabinet assembly 100, a lateral discharge port 302 disposed on a lateral surface with respect to the cabinet assembly 100, and a front discharge port 201 disposed on a front surface with respect to the cabinet assembly 100.

The suction port may be disposed on the back surface of the cabinet assembly 100.

The lateral discharge port 302 may be disposed respectively on the left side and on the right side with respect to the cabinet assembly 100.

The front discharge port 201 may be disposed at the door assembly 200, and the door assembly 200 may further include a door cover assembly 1200 configured to automatically open and close the front discharge port 201.

The door cover assembly 1200 may open the front discharge port 201 and then may move downward along the door assembly 200. The door cover assembly 1200 may move in the up-down direction with respect to the door assembly 200.

After the door cover assembly 1200 moves downward, a long-distance fan assembly 400 may pass through the door assembly 200 to move forwards.

The fan assembly 400 may include a short-distance fan assembly (not illustrated) and the long-distance fan assembly 400. The heat exchange assembly may be disposed at a rear of the short-distance fan assembly and the long-distance fan assembly 400.

The heat exchange assembly may be disposed inside the cabinet assembly 100 and may be disposed in the suction port. The heat exchange assembly may cover the suction port and may be disposed perpendicularly.

The short-distance fan assembly and the long-distance fan assembly 400 may be stacked in the up-down direction. In one embodiment, the long-distance fan assembly 400 may be disposed at an upper side of the short-distance fan assembly. When the long-distance fan assembly 400 is disposed at the upper side of the short-distance fan assembly, discharged air from the long-distance fan assembly may be sent to a far corner of the indoor space.

The short-distance fan assembly may discharge air in a lateral direction with respect to the cabinet assembly 100 through the lateral discharge port 302. The short-distance fan assembly may supply indirect air flow to a user. The short-distance fan assembly may discharge air in leftward and rightward directions of the cabinet assembly 100 at the same time.

The long-distance fan assembly 400 may be disposed at the upper side of the short-distance fan assembly, and may be disposed at an upper side in the cabinet assembly 100.

The long-distance fan assembly 400 may discharge air in a forward direction with respect to the cabinet assembly 100. The long-distance fan assembly may supply direct air flow to the user. Additionally, the long-distance fan assembly may discharge air to a far corner of the indoor space to improve air circulation of the indoor space.

In one embodiment, the long-distance fan assembly 400 may be exposed to the user only when operating. When the long-distance fan assembly 400 operates, the long-distance fan assembly 400 may be exposed to the user by passing through the door assembly 200. When the long-distance fan assembly 400 does not operate, the long-distance fan assembly 400 may be hidden in the cabinet assembly 100.

The long-distance fan assembly 400 may control a direction where air is discharged. The long-distance fan assembly 400 may discharge air upward, downward, leftward, rightward or diagonally with respect to the front surface of the cabinet assembly 100.

The door assembly 200 may be disposed at a front of the cabinet assembly 100 and may be assembled to the cabinet assembly 100.

The door assembly 200 may slide in a left-right direction with respect to the cabinet assembly 100, and may expose a part of the front surface of the cabinet assembly 100 to the outside.

The door assembly 200 may move in any one of the leftward or rightward direction to fully open the inner space. Additionally, the door assembly 200 may move in any one of the leftward or rightward direction to open only a part of the inner space.

In one embodiment, the door assembly 200 may be opened and closed in two stages.

In the first stage opening, the door assembly 200 may be partially opened to supply water to the humidification assembly, and a surface area may be exposed to the extent that a water tank 810 of the humidification assembly is exposed.

In the second stage opening, the door assembly 200 may be opened to its maximum extent for installation and repairs. To this end, the door assembly 200 may be provided with a door stopper structure to control the second stage opening.

The filter assembly 600 may be disposed on the rear surface of the cabinet assembly 100. The filter assembly 600 may swivel to a lateral portion of the cabinet assembly 100 in a state where the filter assembly 600 is disposed on the rear surface of the cabinet assembly 100. A user may separate only the filter from the filter assembly 600 moved to the lateral portion of the cabinet assembly 100.

In one embodiment, the filter assembly 600 includes two parts, and each part may swivel to the left side or the right side.

The moving cleaner 700 is a device for cleaning the filter assembly 600. The moving cleaner 700 may clean the filter assembly 600 while moving in the up-down direction. The moving cleaner 700 may suction air and may separate foreign substances attached to the filter assembly 600 while moving, and the separated foreign substances may be stored in the moving cleaner 700.

The moving cleaner 700 may be installed as a structure that does not interfere with the filter assembly 600 when the filter assembly 600 swivels.

The humidification assembly may supply moisture to the inner space of the cabinet assembly 100, and the supplied moisture may be discharged to the indoor space through the fan assembly. The humidification assembly may include the detachable water tank 810.

In one embodiment, the humidification assembly may be disposed at a lower side in the cabinet assembly 100. The heat exchange assembly and the fan assembly 400 may be disposed at an upper side of the humidification assembly.

<<Configuration of Cabinet Assembly>>

The cabinet assembly 100 may include a base 130 mounted onto the ground, a lower cabinet 120 disposed at an upper side of the base 130, having a front surface, an upper surface and a lower surface that are open, and having a left surface, a right surface and a back surface that are closed, and an upper cabinet 110 disposed at an upper side of the lower cabinet 120, having a back surface provided with the suction port, a front surface and a lower surface that are open, and having a left surface, a right surface, and an upper surface that are closed.

An inside of the upper cabinet 110 is referred to as a first inner space, and an inside the lower cabinet 120 is referred to as a second inner space. The first inner space and the second inner space may constitute the inner space of the cabinet assembly 100.

The short-distance fan assembly, the long-distance fan assembly 400 and the heat exchange assembly may be disposed inside the upper cabinet 110.

The humidification assembly may be disposed inside the lower cabinet 120.

The door assembly 200 may be disposed at the front of the cabinet assembly 100, and may slide in a left-right direction with respect to the cabinet assembly 100.

When the door assembly 200 moves, a part of the left side or the right side of the cabinet assembly 100 may be exposed to the outside.

In one embodiment, a cover 160 may be disposed at a front of the upper cabinet 110 and the lower cabinet 120, and may prevent air in the cabinet 100 from contacting the door assembly 200 directly.

When cold air directly contacts the door assembly 200, dew may be formed, and may adversely affect an electric circuit constituting the door assembly 200.

Accordingly, the cover 160 may be disposed at the front of the upper cabinet 110 and at the front of the lower cabinet 120, and may allow air in the cabinet 100 to flow only to the front discharge port 201 or the lateral discharge port 302.

The cover 160 may include an upper cover 162 configured to cover the front surface of the upper cabinet 110, a lower cover 164 configured to cover the front surface of the lower cabinet 120, and a long-distance fan cover 166 configured to cover a front surface of the long-distance fan assembly 400.

The long-distance fan cover 166 and the upper cover 162 may be integrally formed. In one embodiment, the long-distance fan cover 166 and the upper cover 162 may be separately manufactured and then may be assembled to each other.

The long-distance fan cover 166 may be disposed at a front of the long-distance fan assembly 400, and may be disposed at an upper side of the upper cover 162. Front surfaces of the long-distance fan cover 166 and the upper cover 162 may form a continuous flat surface.

The long-distance fan cover 166 may be provided with a fan cover discharge port 161 that is open in a front-rear direction. The fan cover discharge port 161 may communicate with the front discharge port 201 and may be disposed at a rear of the front discharge port 201. A discharge grille 450 of the long-distance fan assembly 400 may pass through the fan cover discharge port 161 and the front discharge port 201 to move to a front of the door assembly 200.

The door assembly 200 may be disposed at the front of the fan cover discharge port 161, and the fan cover discharge port 161 may be disposed at a rear of a below-described panel discharge port 1101.

The long-distance fan cover 166 may be coupled to an upper side of the front of the upper cabinet 110, and the upper cover 162 may be coupled to a lower side of the front of the upper cabinet 110.

The lower cover 164 may be disposed at a lower side of the upper cover 162 and may be assembled to the lower cabinet 120 or the humidification assembly. After the lower cover 164 is assembled, front surfaces of the lower cover 164 and the upper cover 162 may form a continuous surface.

The lower cover 164 may be provided with a water tank opening 167 that is open in the front-rear direction. The water tank 810 may be separated or installed through the water tank opening 167.

The lower cover 164 may be disposed at a lower side of a front of a drain pan. Although a front surface of the lower cabinet 120 is not entirely covered, air in the upper cabinet 110 may not leak. Accordingly, the front surface of the lower cabinet 120 may not be entirely covered.

For repairs, services and replacements of the humidification assembly, for example, a part of the front surface of the lower cabinet 120 may be opened. In one embodiment, a part of the front surface of the lower cabinet 120 may be provided with an open surface 169 that is not shielded by the lower cover 164.

In one embodiment, when the door assembly 200 is opened to a first stage, the lower cover 164, where the water tank opening 167 is formed, is only exposed to a user, and when the door assembly 200 is opened to a second stage, the open surface 169 may also be exposed to the user.

The door assembly 200 may slide in the left-right direction as a door slide module 1300 operates. A state, in which the water tank opening 167 is entirely exposed as the door assembly 200 slides, is referred to as a first stage opening, and a state, in which the open surface 169 is exposed, is referred to as a second stage opening.

A front surface of the cabinet assembly 100, which is exposed at the time of the first stage opening, is referred to as a first open surface (OP1), and a front surface of the cabinet assembly, which is exposed at the time of the second stage opening, is referred to as a second open surface (OP2).

<<<Configuration of Door Assembly>>>

The door assembly 200 may include a front panel 210 where a front discharge port 201 is formed, a panel module 1100 coupled to a back surface of the front panel 210 and provided with a panel discharge port 1101 communicating with the front discharge port 201, a door cover assembly 1200 disposed at the panel module 1100 and configured to open and close the panel discharge port 1101 and the front discharge port 201, a door slide module 1300 disposed at the panel module 1100 and configured to move the panel module 1100 in a left-right direction with respect to a cabinet assembly 100, a camera module 1900 disposed at an upper side of the panel module 1100 and configured to capture an image of an indoor space, and a cable guide 1800, an upper end of which is assembled to the door cover assembly 1200 to move relative to the door cover assembly 1200, a lower end of which is assembled to the panel module assembly 1100 to move relative to the panel module assembly 1100, and in which a cable connected to the door cover assembly 1200 is stored.

The front discharge port 201 may be disposed on the front panel 210, and may be open in a front-rear direction. The panel discharge port 1101 may be disposed at the panel module 1100 and may be open in the front-rear direction.

Surface areas and shapes of the front discharge port 201 and the panel discharge port 1101 may be the same, and the front discharge port 201 may be disposed further forward than the panel discharge port 1101.

The door assembly 200 may further include a display module 1500 installed at the panel module 1100 and configured to provide information of the indoor unit to the front panel 210 visually.

The display module 1500 may be disposed on a back surface of the front panel 1100 and may provide visual information to a user through the front panel 1100.

Alternatively, the display module 1500 may be partially exposed by passing through the front panel 1100 and may provide the visual information to the user through an exposed display.

In one embodiment, information of the display module 1500 may be delivered to a user through a display opening 202 formed on the front panel 210.

<<Configuration of Front Panel>>

The front panel 210 may be disposed on a front surface of the indoor unit. The front panel 210 may include a front panel body 212, a front discharge port 201 which is open in a front-rear direction of the front panel body 212, a display opening 202 which is open in the front-rear direction of the front panel body 212, a first front panel side 214 disposed on a left side of the front panel body 212 and configured to cover a left surface of a panel module 1100, and a second front panel side 216 disposed on a right side of the front panel body 212 and configured to cover a right surface of the panel module 1100.

For the front panel 210, an up-down length may be larger than a left-right width. In one embodiment, the up-down length of the front panel 210 may be three or more times larger than the left-right width. For the front panel 210, a front-rear thickness may be much smaller than the left-right width. In one embodiment, the front-rear thickness of the front panel 210 may be less than one fourth of a left-right width of the front panel 210.

In one embodiment, the display opening 202 may be disposed at a lower side of the front discharge port 201. Unlike the embodiment, the display opening 202 may be disposed at an upper side of the front discharge port 201.

The front discharge port 201 and the display opening 202 may be arranged in the up-down direction. A virtual central axis (C) connecting a center of the front discharge port 201 and a center of the display opening 202 may be perpendicularly disposed. A left side and right side of the front panel 210 may be symmetrical with respect to the central axis (C).

A camera 1950 of the camera module 1900 may be disposed on the central axis (C).

The front discharge port 201 may be formed in a circle shape. The shape of the front discharge port 201 may correspond to a shape of a front surface of a discharge grille 450. The discharge grille 450, hidden in the cabinet assembly 100, may be exposed outward through the front discharge port 201.

In one embodiment, the discharge grille 450 may be exposed outward as the front discharge port 201 is optionally opened, and may pass through the front discharge port 201 to protrude further forward than the front panel 210.

When the discharge grille 450 protrudes further than the front panel 210, interference between air passing through the discharge grille 450 and the front panel 210 may be minimized, and discharged air may flow farther away.

The first front panel side 214 may protrude from a left edge of the front panel body 212 to a rear, and may cover the left surface of the panel module 1100 fixed onto a back surface of the front panel body 212.

The second front panel side 216 may protrude from a right edge of the front panel body 212 to the rear, and may cover a right surface of the panel module 1100 fixed onto the back surface of the front panel body 212.

The first front panel side 214 and the second front panel side 216 may prevent lateral surfaces of the panel module 1100 from being exposed to the outside.

Additionally, a first front panel end 215 protruding from an end of a rear of the first front panel side 214 towards the second front panel side 216 may be further disposed. A second front panel end 217 protruding from an end of a rear of the second front panel side 216 towards the first front panel side 214 may be further disposed.

The first front panel end 215 and the second front panel end 217 may be disposed on a back surface of the panel module 1100. That is, the panel module 1100 may be disposed between the front panel body 212 and the front panel ends 215, 217.

In one embodiment, a gap between the front panel body 212 and the front panel ends 215, 217 is defined as an inner gap (I) of the front panel. The inner gap (I) may be smaller than the front-rear thickness of the front panel 210.

The first front panel end 215 and the second front panel end 217 may be disposed to face each other and may be spaced apart from each other. In one embodiment, a gap between the first front panel end 215 and the second front panel end 217 is defined as an open gap (D) of the front panel. The open gap (D) of the front panel 210 may be smaller than the left-right width (W1) of the front panel 210.

In one embodiment, the front panel body 212 and the front panel ends 215, 217 may be disposed in parallel. The front panel body 212 and the front panel sides 214, 216 may intersect, and in one embodiment, may be orthogonally disposed. The front panel side 214, 216 may be disposed in the front-rear direction.

In one embodiment, the front panel body 212, the front panel sides 214, 216 and the front panel ends 215, 217 constituting the front panel 210 may be integrally manufactured.

In one embodiment, the entire front panel 210 may be made of a metallic material. Specifically, the entire front panel 210 may be made of aluminum.

Accordingly, the front panel sides 214, 216 may be bent from the front panel body 212 to a rear, and the front panel ends 215, 217 may be bent from the front panel sides 214, 216 to an opposite side.

In order for the front panel 210, entirely made of a metallic material, to be easily bent, a first bent groove may be formed at a bent portion between the front panel body 212 and the first front panel side 214, and a second bent groove may be formed at a bent portion between the front panel body 212 and the second front panel side 216.

Additionally, a third bent groove may be formed at a bent portion between the first front panel side 214 and the first front panel end 215, and a fourth bent groove may be formed at a bent portion between the second front panel side 216 and the second front panel end 217.

Each of the bent grooves may be long and extended vertically in a lengthwise direction of the front panel 210. For example, each bent groove may be disposed inside the bent portions. In case the first and second bent grooves are not formed, an angle between the front panel body 212 and the front panel side may not be a right angle. Further, in case the first and second bent grooves are not formed, the bent portion between the front panel body 212 and the front panel side may not be flat, and during a bending process, may protrude or may be deformed in various directions. The third and fourth bent grooves may perform the same function as the first and second bent grooves.

A panel upper opening 203 and a panel lower opening 204 may be respectively formed at an upper side and lower side of the front panel 210. In one embodiment, a single metallic plate may be bent to manufacture the front panel 210. Accordingly, the panel upper opening 203 and the panel lower opening 204 may have the same surface area and shape.

A thickness of the panel module 1100 may be the same as or smaller than the gap between the front panel body 212 and the front panel ends 215, 217. The panel module 1100 may be inserted through the panel upper opening 203 or the panel lower opening 204. The panel module 1100 may be fixed by a coupling member (not illustrated) that passes through the respective front panel ends 215, 217.

The camera module 1900 may be inserted into the panel upper opening 203 and may be disposed at an upper side of the panel module 1100. The camera module 1900 may close the panel upper opening 203.

The camera module 1900 may be disposed at the upper side of the front discharge port 201 and may be disposed at a back surface of the front panel 210. The camera module 1900 may be hidden by the front panel 210. The camera module 1900 may be exposed to the upper side of the front panel 210 when the camera module 1900 operates, and may be hidden behind the front panel 210 when the camera module 1900 does not operate.

The front panel ends 215, 217 may surround lateral surfaces and a back surface of the camera module 1900, and the coupling member (not illustrated) may pass through the respective front panel end 215, 217 and then may be coupled to the camera module 1900.

In one embodiment, a left-right width of the panel upper opening 203 and a left-right width of the camera module 1900 may be the same. Further, in one embodiment, the left-right width of the panel upper opening 203 and a left-right width of the panel module 1100 may be the same.

In one embodiment, a front-rear thickness of the panel upper opening 203 and a front-rear thickness of the camera module 1900 may be the same. Further, in one embodiment, the front-rear thickness of the panel upper opening 203 and the front-rear thickness of the panel module 1100 may be the same.

Accordingly, the camera module 1900 and the panel module 1100 may be disposed between the front panel body 212 and the front panel ends 215, 217 and may be supported by the front panel body 212 and the front panel ends 215, 217.

<<Configuration of Panel Module>>

The panel module 1100 may include an upper panel module 1110 and a lower panel module 1120. Unlike the embodiment, the upper panel module 1110 and the lower panel module 1120 may be integrally formed. In one embodiment, an up-down length of a front panel 210 may be much longer than a left-right width (W1) of the front panel 210. In case the panel module 1100 is manufactured as a single part, it is difficult for the panel module 1100 to be inserted through a panel upper opening 203 or a panel lower opening 204.

In one embodiment, the panel 1100 may include an upper panel module 1110 and a lower panel module 1120. The upper panel module 1110 may be inserted into the front panel 210 through the panel upper opening 203, and the lower panel module 1120 may be inserted into the front panel 210 through the panel lower opening 204.

When the panel 1100 includes two parts, the upper panel module 1110 or the lower panel module 1120 may be easily repaired and replaced. The integrally formed upper panel module 1110 and lower panel module 1120 may prevent the front panel 210 from being twisted and may provide rigidity against an external force to the front panel 210.

For example, when the upper panel module 1110 is separated, the door cover assembly 1200 may be replaced, and when the lower panel module 1120 is separated, the door slide module 1300 may be replaced.

The upper panel module 1110 and the lower panel module 1120 may be inserted into an inner gap (I) of the front panel 210, may support the front panel 210 and may prevent the front panel 210 from being deformed and bent.

In one embodiment, the upper panel module 1110 and the lower panel module 1120 may be manufactured as a molded material. The upper panel module 1110 and the lower panel module 1120 manufactured as a molded material may contact a front panel body 212, each front panel sides 214, 216 and each front panel ends 215, 217.

As the upper panel module 1110 and the lower panel module 1120 support the front panel body 212, each front panel sides 214, 216 and each front panel ends 215, 217, the front panel 210 made of a metallic material may be prevented from being bent and deformed.

In one embodiment, the upper panel module 1110 and the lower panel module 1120 may support entire surfaces of a first front panel side 214 and a second front panel side 216, to which an external impact is frequently applied.

Additionally, to reduce an entire load of the door assembly 200, the upper panel module 1110 and the lower panel module 1120 may support only a partial surface area of the front panel body 212 rather than an entire surface area of thereof. That is, the upper panel module 1110 and the lower panel module 1120 may form a plurality of curves in a front-rear direction and may support a partial surface area of a back surface of the front panel body 212.

<Configuration of Upper Panel Module>

The upper panel module 1110 may include an upper panel body 1130 disposed on a back surface of a front panel 210, and a panel discharge port 1101 formed to pass through the upper panel body 1130 in a front-rear direction, disposed at a rear of a front discharge port 201 and communicating with the front discharge port 201.

The panel discharge port 1101 may correspond to the front discharge port 201. In one embodiment, the panel discharge port 1101 and the front discharge port 201 may all be shaped in a circle. To prevent discharged air from leaking, a gasket may be disposed between the panel discharge port 1101 and the front discharge port 201.

The gasket may be disposed along an inner surface of the front discharge port 201, and the upper panel module 1110 may closely contact the gasket. The panel discharge port 1101 may be disposed on a back surface of the gasket.

The panel discharge port 1101 may have a surface area the same as or larger than that of the front discharge port 201. In one embodiment, the panel discharge port 1101 may have larger diameter than the front discharge port 201 considering an installation structure of the gasket. The gasket may closely contact the inner surface of the front discharge port 201 and an inner surface of the panel discharge port 1101, and may seal a gap between the upper panel module 1110 and the front panel 210.

The discharge grille 450 of the long-distance fan assembly 400 may consecutively pass through the panel discharge port 1101 and the front discharge port 201 and may protrude further forward than a front surface of the front panel 210.

When the discharge grille 450 protrudes outward, an end of a front of a fan housing of the long-distance fan assembly 400 may closely contact the gasket. When the end of the front of the fan housing closely contacts the gasket, air flowing in the fan housing may be prevented from leaking to the door assembly 200.

In case discharged air of the long-distance fan assembly 400 leaks into the door assembly 200, dew may be formed in the door assembly 200.

As the front panel 210 is made of a metallic material, discharged air leaking into the door assembly 200 may cool surroundings of the front discharge port 201 and may cause formation of a large amount of dew around the front discharge port 201 at the time of cooling.

In one embodiment, a door cover assembly 1200 and a display module 1500 may be installed at the upper panel module 1110.

The door cover assembly 1200 and the display module 1500 may all be disposed within a thickness of the front panel 210 in a state of being assembled to the upper panel module 1110.

To this end, the upper panel module 1110 may be provided with a display installation part 1112, and the display module 1500 may be installed at the display installation part 1112. Through the display installation part 1112, forward protrusion of the display module 1500 from the upper panel body 1130 may be minimized.

The display installation part 1112 may be disposed to pass through the upper panel module 1110 in the front-rear direction.

The display module 1500 may be partially exposed outward through a display opening 202 of the front panel 210 in a state of being assembled to the upper panel module 1110. In a state where the display module 1500 is exposed outward through the display opening 202, a display 1510 of the display module 1500 may form a continuous surface along with a front surface of the front panel 210.

That is, a front surface of the display 1510 of the display module 1500 may not protrude further forward than the front panel 210 and may form a continuous surface along with the front surface of the front panel 210.

The display module 1500 may receive and transmit power and electric signals through a cable passing through the upper panel module 1110.

The door cover assembly 1200 may be disposed on a back surface of the upper panel module 1110, and may move in an up-down direction along the back surface of the upper panel module 1110.

When the door cover assembly 1200 opens the front discharge port 201 by moving downward, the door cover assembly 1200 may be placed at a height the same as that of the display module 1500.

The door cover assembly 1200 may not be coupled to a panel module 1100. The door cover assembly 1200 may move in the up-down direction with respect to the panel module 1100.

In one embodiment, the upper panel module 1110 and a lower panel module 1120 may be stacked in the up-down direction. The upper panel module 1110 and the lower panel module 1120 may be assembled to each other in the front panel 210. Accordingly, when a door assembly 200 slides, a shake or noise in operation may be minimized.

To this end, the upper panel module 1110 and the lower panel module 1120 may be assembled in the form of a press fit. Any one of the upper panel module 1110 and the lower panel module 1120 may be provided with a panel projection part protruding towards the other, and the other may be provided with a panel insertion part into which the panel projection part is accommodated.

In one embodiment, the upper panel module 1110 may be provided with the panel projection part 1113. The panel projection part 1113 may protrude downward from a lower surface of the upper panel body 1130.

The lower panel module 1120 may be provided with the panel insertion part 1123 to accommodate the panel projection part 1113 and to be assembled to the panel projection part 1113 in the form of a press fit.

The panel insertion part 1123 may be formed on an upper surface of the lower panel module 1120.

<Configuration of Lower Panel Module>

The lower panel module 1120 may be installed on a back surface of a front panel 210. The lower panel module 1120 may be installed in an inner gap (I) of the front panel 210. The lower panel module 1120 may be disposed at a lower side of the upper panel module 1110, may support the upper panel module 1110 and may be assembled to the upper panel module 1110.

The lower panel module 1120 may be installed in the front panel 210 and may prevent the front panel 210 from being deformed. The lower panel module 1120 may be press-fitted to the upper panel module 1110 and may support the upper panel module 1110 from a lower side.

The lower panel module 1120 may include a lower panel body 1122 assembled to the front panel 210. The panel insertion part 1123, press-fitted to the panel projection part 1113 of the upper panel module 1110, may be formed at an upper side of the lower panel body 1122. The panel insertion part 1123 may be concaved downward.

A driver of a door slide module 1300 may be installed at the lower panel module 1120.

The lower panel module 1120 may be fixed to the front panel 210 by a coupling member (not illustrated) respectively passing through a first front panel end 215 and a second front panel end 217.

To fix the upper panel module 1110 and the lower panel module 1120, the coupling members may all be disposed on a back surface of the first front panel end 215 and the second front panel end 217. Accordingly, a coupling structure of the door assembly 200 may be hidden instead of being exposed to the outside.

Specifically, a coupling member or a hole for a coupling may be hidden behind an outer surface of the front panel 210 made of a metallic material without being exposed to the outside.

<<Configuration of Door Cover Assembly>>

The door cover assembly 1200 is a component for opening and closing the front discharge port 201 disposed at the door assembly 200.

The door cover assembly 1200 may extend a moving path of the long-distance fan assembly 400 by opening the front discharge port 201. The long-distance fan assembly 400 may protrude outside the door assembly 200 through the opened front discharge port 201.

The door cover assembly 1200 may initially be disposed on the moving path of the long-distance fan assembly 400, and when opening the front discharge port 201, the door cover assembly 1200 may move out of the moving path of the long-distance fan assembly 400.

<Configuration of Cable Guide>

A door housing moving module 1700 may move in an up-down direction. Accordingly, a cable connecting to the door housing moving module 1700 may also move in the up-down direction.

A front-rear thickness of the door assembly 200 is much smaller than a width (W1) of the door assembly 200. Accordingly, when the door housing moving module 1700 moves in the up-down direction, the cable may be twisted.

Further, the cable may get stuck between the door housing moving module 1700 moving in the up-down direction and a panel module 1100, causing limitations in operation of the door housing moving module 1700. To prevent this from happening as much as possible, a cable guide 1800 may be disposed.

An upper end of the cable guide 1800 may be assembled to the door cover assembly 1200, and a lower end may be assembled to the panel module 1100.

The cable guide 1800 may include a first cable guide 1810 assembled to the door cover assembly 1200 to be able to rotate relative to the door cover assembly 1200, a second cable guide 1820 assembled to the panel module 1100 to be able to rotate relative to the panel module 1100, and a connection cable guide 1830 assembled respectively to the first cable guide 1810 and the second cable guide 1820 to be able to rotate relative to the first cable guide 1810 and the second cable guide 1820.

<<Configuration of Door Slide Module>>

The door slide module 1300 is a component for moving the door assembly 200 in leftward and rightward directions of the cabinet assembly 100. The door slide module 1300 may allow the door assembly 200 to reciprocate in a left-right direction.

The door slide module 1300 may be disposed around a center of gravity of the door assembly 200, for example. Accordingly, the door slide module 1300 may be disposed around a center of a height at which the door assembly 200 is disposed.

The door slide module 1300 may be installed at any one of the door assembly 200 or the cabinet assembly 100, and may implement a sliding movement on the basis of interference between the door slide module and the other.

The door slide module 1300 may include a rack 1310 disposed at the door assembly 200 and extending in a left-right direction, a gear assembly 1330 disposed at a structure (in one embodiment, a fixed plate) at the cabinet assembly 100 side, engaged with the rack 1310 and at the time of rotation, configured to move the rack 1310, a gear driving motor 1320 disposed at a structure (in one embodiment, the fixed plate) at the cabinet assembly 100 side and configured to supply a driving force to the gear assembly 1330, and a gear housing 1380 disposed at a structure at the cabinet assembly 100 side and provided with the gear assembly 1330 and the gear driving motor 1320.

The structure at the cabinet assembly 100 side may be any component fixed to the cabinet assembly 100. In one embodiment, a fixed plate 190 may be disposed at a front of the cabinet assembly 100. An up-down length of the fixed plate 190 may be larger than a width (W2) of the fixed plate 190. The left-right width (W2) of the fixed plate 190 may be smaller than half the left-right width (W1) of the door assembly 200. The fixed plate 190 may be disposed in a direction where the door assembly 200 moves.

The rack 1310 may be disposed in the left-right direction. In one embodiment, the rack 1310 may be disposed horizontally. The rack 1310 may be disposed at a center with respect to an up-down direction of the door assembly 200, for example.

A driving force supplied by the door slide module 1300 may be delivered to the rack 1310. Accordingly, when a center of gravity of the door assembly 200 becomes farther from the rack 1310, moment caused by a load may become greater.

When a driving force supplied by the door slide module 1300 is around the center of gravity of the door assembly 200, an upper side and a lower side of the door assembly 200 may move evenly. For example, when the door slide module 1300 is disposed at the lower side of the door assembly and supplies a driving force, movement of the upper side of the door assembly 200 may be later than a movement of the lower side of the door assembly 200.

As the door slide module 1300 is disposed at a center with respect to the up-down direction of the door assembly 200, distances moved by the upper side and the lower side of the door assembly may be evenly created.

In case moment (with respect to the center of gravity of the door assembly) caused by driving of the door slide module 1300 is greater than moment caused by a load of the door assembly 200, noise may be made when the door assembly 200 slides. In one embodiment, as moment caused by the driving of the door slide module 1300 may be smaller than moment caused by the load of the door assembly, the door slide module 1300 may not make noise.

In one embodiment, the door slide module 1300 may be disposed at a lower side of a below-described middle rail 1420, and the rack 1310 may be disposed at a front of the middle rail 1420.

The rack 1310 may include a rack body 1312 extending in the left-right direction, and a plurality of rack teeth parts 1311 disposed at the rack body 1312, formed in the up-down direction at the rack body 1312 and disposed along a lengthwise direction of the rack body 1312.

The rack teeth part 1311 may be formed to face upward or downward. In one embodiment, the rack teeth part 1311 may protrude downward from the rack body 1312.

The rack teeth part 1311 may be separately manufactured and then assembled to the rack body 1312. In one embodiment, the rack teeth part 1311 and the rack body 1312 may be integrally manufactured.

Teeth of the rack teeth part 1311 may be disposed in a front-rear direction. The plurality of rack teeth parts 1311 may be disposed in the left-right direction. The gear assembly may be engaged with the rack teeth part 1311, and when the gear assembly operates, the rack 1310 including the rack teeth part 1311 may move in the left-right direction.

The gear assembly 1300 may be fixed to the fixed plate 190. In one embodiment, the gear housing 1380 may be assembled to the fixed plate 190 in a state where the gear assembly 1300 is installed in the gear housing 1380.

The gear assembly 1330 may include a first gear 1340 disposed in the gear housing 1380, provided with a first teeth part 1341 on an outer circumferential surface thereof and engaged with the rack 1310 through the first teeth part 1341, a second gear 1350 disposed in the gear housing 1380, including a 2-1 teeth part 1351 and a 2-2 teeth part 1352 having different radii of curvature and engaged with the first teeth part 1341 of the first gear 1340 through the 2-1 teeth part 1351, a third gear part 1360, the third gear 1360 disposed in the gear housing 1380, including a 3-1 teeth part 1361 and a 3-2 teeth part 1362 having different types of teeth and engaged with the 2-2 teeth part 1352 of the second gear 1350 through the 3-1 teeth part 1361, and a worm gear 1370 disposed in the gear housing 1380, engaged with the 3-2 teeth part 1362, connected to the gear driving motor 1320 and configured to rotate.

The gear assembly may include a worm gear 1370 coupled to the gear driving motor and configured to rotate, and may reduce noise in operation as much as possible based on operation of the worm gear 1370. The worm gear 1370 may keep itself engaged with the third gear 1360. Accordingly, even when an external force is applied to the door assembly 200, the door assembly 200 may resist moving due to the external force. In case a pinion gear is substituted for the worm gear 1370, the door assembly 200 may be easily moved by an external force when the external force is applied in a transverse direction of the door assembly 200.

Teeth of each of the first gear 1340, the second gear 1350 and the third gear 1360 may be formed in pinion gear-type ones.

The first gear 1340, the second gear 1350 and the third gear 1360 may be disposed perpendicularly with respect to the front-rear direction. That is, the first gear 1340, the second gear 1350 and the third gear 1360 may be disposed in parallel with a front body 212 of a front panel 210.

An axis of rotation of each of the first gear 1340, the second gear 1350 and the third gear 1360 may be disposed in the front-rear direction.

In one embodiment, a motor shaft 1321 of the gear driving motor 1320 may pass through the worm gear 1370. An axis of rotation of the worm gear 1370 may be disposed on the same line as the motor shaft 1321.

In one embodiment, the motor shaft 1321 may be dispose diagonally when seen from a front or a rear. The motor shaft 1321 may form a contained angle (θ) with respect to a horizontal direction.

A direction in which the motor shaft 1321 is disposed crosses a direction in which the rack 1310 is disposed. In one embodiment, an angle between the direction in which the motor shaft 1321 is disposed and the direction in which the rack 1310 is disposed may be between 0 degrees and 90 degrees.

The first gear 1340 may be installed in the gear housing 1380 and a portion of the first gear 1340 may protrude out of the gear housing 1380. The portion protruding out of the gear housing 1380 may be engaged with the rack 1310.

The first gear 1340 may be engaged respectively with the rack 1310 and the second gear 1350.

The second gear 1350 may be engaged respectively with the first gear 1340 and the third gear 1360.

The third gear 1360 may be engaged respectively with the second gear 1350 and the worm gear 1370.

The first gear 1340 may be a pinion gear where an axis of rotation is formed in the front-rear direction.

The first teeth part 1341 may be disposed in the shape of a circle when seen from a front or a rear.

A position where the first teeth part 1341 and the rack teeth part 1311 are engaged differs from a position where the first teeth part 1341 and the 2-1 teeth part 1351 are engaged. The first teeth part 1341, the rack teeth part 1311 of the rack 1310 and the 2-1 teeth part 1351 may have the same size and the same shape.

The first teeth part 1341, the rack teeth part 1311 of the rack 1310 and the 2-1 teeth part 1351 may all be formed in a pinion gear-type one.

The axes of rotation of the second gear 1350 and the third gear 1360 may be formed in the front-rear direction and in the form of a pinion gear-type one.

Like the first gear 1340, the second gear 1350 and the third gear 1360 each may have two different types of teeth instead of having a single type of teeth.

The 2-1 teeth part 1351 and the 2-2 teeth part 1352 may be disposed at the second gear 1350, and the 2-1 teeth part 1351 and the 2-2 teeth part 1352 may be arranged in a direction (in one embodiment, the front-rear direction) of the axis of rotation of the second gear 1350.

That is, the 2-1 teeth part 1351 and the 2-2 teeth part 1352 may be arranged in the front-rear direction.

The 2-1 teeth part 1351 and the 2-2 teeth part 1352 may all be formed in a pinion gear-type one but may be different to each other.

When seen from a front, the 2-1 teeth part 1351 and the 2-2 teeth part 1352 may be disposed in the shape of circles having different diameters.

Any one of the 2-1 teeth part 1351 and the 2-2 teeth part 1352 may be disposed at a front and the other may be disposed at a rear. In one embodiment, the 2-1 teeth part 1351 may be disposed further forward than the 2-2 teeth part 1352.

The 2-1 teeth part 1351 may be disposed on the same flat surface as the first teeth part 1341 and the 3-2 teeth part 1362.

Additionally, the second gear 1350 has to keep itself engaged with the first gear 1340 and the third gear 1360 at the same time. Accordingly, the first gear 1340 and the third gear 1360 may be provided with a teeth type the same as that of the second gear 1350. With this structure, the 2-2 teeth part 1352, the first teeth part 1341 and the 3-1 teeth part 1361 may satisfy the same standard.

In one embodiment, for the second gear 1350, a diameter of the 2-2 teeth part 1352 may be larger than that of the 2-1 teeth part 1351. Since the 2-1 teeth part 1351 and the 2-2 teeth part 1352 having different diameters are disposed, the second gear 1350 may be engaged with the first gear 1340 and the third gear 1360 at the same time.

In a state where the first gear 1340 and the second gear 1350 are engaged, the first gear 1340 may be disposed further forward than the 2-2 teeth part 1352. This is because the 2-1 teeth part 1351 is disposed further forward than the 2-2 teeth part 1352.

Unlike the embodiment, the 2-2 teeth part 1352 may be disposed further forward than the 2-1 teeth part 1351 in the front-rear direction.

For the second gear 1350, the 2-1 teeth part 1351 and the 2-2 teeth part 1352 may have different types of teeth. The 2-1 teeth part 1351 and the 2-2 teeth part 1352 may all be formed in a pinion gear-type one.

The third gear 1360 may include the 3-1 teeth part 1361 and the 3-2 teeth part 1362. Any one of the 3-1 teeth part 1361 and the 3-2 teeth part 1362 may be engaged with the worm gear 1370.

In one embodiment, the 3-1 teeth part 1361 and the 3-2 teeth part 1362 may have different diameters. For example, a diameter of the 3-2 teeth part 1362 engaged with the worm gear 1370 may be larger than that of the 3-1 teeth part 1361.

The 3-2 teeth part 1362 may be engaged with the worm gear's teeth part 1371. Accordingly, in case the 3-2 teeth part 1362 has a smaller diameter than the 3-1 teeth part 1361, interference may occur.

The axis of rotation of the third gear 1360 may be disposed in the front-rear direction.

The 3-1 teeth part 1361 and the 3-2 teeth part 1362 may be arranged in the front-rear direction. The 3-1 teeth part 1361 may be disposed further rearward than the 3-2 teeth part 1362.

The 3-1 teeth part 1361 may be disposed on the same flat surface as the 2-2 teeth part 1352. The 3-2 teeth part 1362 may be disposed on the same flat surface as the 2-1 teeth part 1351.

In one embodiment, the 3-2 teeth part 1362 may be engaged with the worm gear 1370, and teeth of the 3-2 teeth part 1362 may be formed in pinion gear-type ones.

As the 3-1 teeth part 1361 is engaged with the 2-2 teeth part 1352, the 3-1 teeth part 1361 may be formed in a pinion gear-type one.

The worm gear 1370 may have a cylindrical shape as a whole, and an axis of rotation of the worm gear 1370 may be disposed to incline with respect to the left-right direction. The worm gear 1370 may be provided with warm gear teeth 1371 on an outer circumferential surface thereof, and the worm gear teeth 1371 may be shaped in a spiral.

The axis of rotation of the worm gear 1370 may be disposed in an inclination direction and may be disposed at a lower side of the third gear 1360.

The worm gear 1370 may directly connect to the motor shaft 1321 of the gear driving motor 1320. The motor shaft 1321 of the gear driving motor 1320 may pass through a center of rotation of the worm gear 1370.

In one embodiment, a step motor may be used as the gear driving motor 1320.

The first gear 1340, the second gear 1350, the third gear 1360, the worm gear 1370 and the gear driving motor 1320 may be assembled to the gear housing 1380.

The gear housing 1380 may provide axes of rotation of the first gear 1340, the second gear 1350 and the third gear 1360. The first gear 1340, the second gear 1350 and the third gear 1360 may be assembled to each boss 1342 formed in the gear housing 1380.

In one embodiment, the gear housing 1380 may include a first gear housing 1381 and a second gear housing 1382.

The first gear 1340, the second gear 1350, the third gear 1360, the worm gear 1370 and the gear driving motor 1320 may be installed between the first gear housing 1381 and the second gear housing 1382.

Each boss 1342, which provides the axes of rotation of the first gear 1340, the second gear 1350 and the third gear 1360, may protrude from any one of the first gear housing 1381 and the second gear housing 1382. The boss 1342 may protrude forward from the first gear housing 1381.

In one embodiment, the first gear housing 1381 may be disposed further rearward than the second gear housing 1382. The first gear housing 1381 may be assembled to a front surface of the fixed plate 190.

Among the gears of the gear assembly 1330, the first gear 1340 may only protrude outside the gear housing 1380. The first gear 1340 may pass through an upper surface of the gear housing 1380 and may partially protrude outward. In order for the first gear 1340 to protrude outward, a part of the upper surface of the gear housing 1380 may be open.

The first teeth part 1341 of the first gear 1340, protruding outside the gear housing 1380, may be engaged with the rack teeth part 1311 of the rack 1310.

The gear housing 1380 is assembled to a structure at the cabinet assembly 100 side. Accordingly, when the gear driving motor 1320 operates, the first gear 1340 may rotate in place, and the rack 1310 engaged with the first gear 1340 may move in the left-right direction.

In one embodiment, the door slide module 1300 may be disposed at a height of a center of the door assembly 200. This relates to a center of gravity of the door assembly 200.

In one embodiment, a single gear driving motor 1320 for moving the door assembly 200 is disposed. Accordingly, the gear driving motor 1320 may be close to the center of gravity of the door assembly 200, for example.

Unlike the embodiment, in case the door slide module 1300 is disposed at an upper side or a lower side of the door assembly 200, a portion where the rack is disposed may only move while the opposite portion may not move. This may result from a height of the door assembly 200 according to the disclosure, being larger than the width (W1) of the door assembly 200.

In case the rack is disposed at the lower side of the door assembly 200 including the front panel 210 made of a metallic material, the lower side may only be moved by a driving force of the gear driving motor, and the upper side may not move due to its self-weight of the door assembly 200 or movement of the upper side may be delayed.

In case a delay occurs at the time of the movement of the door assembly 200, noise in operation of the door assembly 200 may be made, and the door assembly 200 may temporarily stop and then may move.

According to the present disclosure, the rack 1310 may be disposed at a center of an up-down height of the door assembly 200. Accordingly, although a single gear driving motor 1320 operates, the entire door assembly 200 including the upper side and the lower side of the door assembly 200 may move uniformly.

<<Side Moving Assembly>>

The indoor unit according to the embodiment may be further provided with the side moving assembly 1400 configured to guide a left-right sliding movement of the door assembly 200 and to support a load of the door assembly 200.

The side moving assembly 1400 may be disposed at the door assembly 200 and the cabinet assembly 100, and may guide a left-right movement of the door assembly 200.

When the door slide module 1300 operates, the side moving assembly 1400 may guide a sliding movement of the door assembly 200. Operation of the rack 1310 and the gear assembly 1330 of the door slide module 1300 may ensure a sliding movement of the door assembly 200 but may not ensure a smooth sliding movement of the door assembly 200.

In one embodiment, the side moving assembly 1400 may be disposed respectively at an upper side, a center and a lower side of the door assembly 200.

The side moving assembly 1400 may include a top rail 1410 disposed at the upper side of the door assembly 200, a middle rail 1420 disposed at a center of the door assembly 200, a bottom rail 1430 disposed at the lower side of the door assembly 200, a top supporter 1440 assembled to the door assembly 200, disposed at the upper side of the door assembly 200 and hung on an upper side of the cabinet assembly 100, and a bottom supporter 1450 which is assembled to the cabinet assembly 100, which is disposed at a lower side of the cabinet assembly 100 and at which a lower end of the door assembly 200 is hung.

The top rail 1410, the middle rail 1420 and the bottom rail 1430 may all be disposed in a left-right direction. The top rail 1410, the middle rail 1420 and the bottom rail 1430 may be disposed between the door assembly 200 and the cabinet assembly 100.

The top rail 1410 may include a first rail 1412 extending in the left-right direction, a second rail 1414 extending in the left-right direction and having a shorter length than the first rail 1412, and a bearing housing 1416 disposed between the first rail 1412 and the second rail 1414, assembled respectively to the first rail 1412 and the second rail 1414 to be able to move relative to the first rail 1412 and the second rail 1414, and configured to reduce friction respectively with the first rail 1412 and the second rail 1414 on the basis of rolling friction of a bearing 1415 when the second rail 1414 moves.

The bearing housing 1416 may be assembled to the first rail 1412, and may move along a lengthwise direction of the first rail 1412. The second rail 1414 may be assembled to the bearing housing 1416, and may move along a lengthwise direction of the bearing housing 1416.

That is, the second rail 1414 may be assembled to the bearing housing 1416 to be able to move relative to the bearing housing 1416, and the bearing housing 1416 may be assembled to the first rail 1412 to be able to move relative to the first rail 1412.

The bearing housing 1416 may be shorter than the first rail 1412 and may be longer than the second rail 1414. The bearing housing 1416 and the second rail 1414 may slide only within a length of the first rail 1412.

In one embodiment, the first rail 1412 may be coupled and fixed to the door assembly 200, and the second rail 1414 may be coupled and fixed to a structure at the cabinet assembly 100 side.

As the first rail 1412, which is long, is fixed to a back surface of the door assembly 200, the first rail 1412 may be prevented from being exposed to the outside when the door assembly 200 makes a left-right movement.

The short-length second rail 1414 may be installed at a structure at the cabinet assembly 100 side but may not move a distance longer than the length of the first rail 1412. Accordingly, the second rail 1414 may not be exposed to the outside.

The second rail 1414 may be disposed in a direction where the door assembly 200 moves. In case the door assembly 200 slides in a leftward direction as in one embodiment, the second rail 1414 may be disposed on a left side with respect to the cabinet assembly 100.

In one embodiment, the second rail 1414 may be disposed on the left side with respect to a center line (Y). The second rail 1414 may be eccentric to one side with respect to the center line (Y), for example.

The center line (Y) may be a virtual line placed at a center with respect to a left-right width (W1) of the door assembly 200 and extending in an up-down direction.

As the second rail 1414, configured to support a load of the door assembly 200, is eccentric to one side with respect to the center line (Y), eccentricity caused due to movement of the door assembly 200 may be minimized when the door assembly 200 moves.

A distance moved by the door assembly 200 may be less than half the left-right width (W1) of the door assembly 200, for example. In one embodiment, the door assembly 200 may move a distance which is less than one third of the left-right width.

Configurations of the middle rail 1420 and the bottom rail 1430 may be the same as that of the top rail 1410.

The middle rail 1420 may include a first rail 1422 extending in the left-right direction, a second rail 1424 extending in the left-right direction and having a shorter length than the first rail 1422, and a bearing housing 1426 disposed between the first rail 1422 and the second rail 1424, assembled respectively to the first rail 1422 and the second rail 1424 to be able to move relative to the first rail 1422 and the second rail 1424, and configured to reduce friction respectively with the first rail 1422 and the second rail 1424 on the basis of rolling friction of a bearing when the second rail 1424 moves.

The bottom rail 1430 may include a first rail 1432 extending in the left-right direction, a second rail 1434 extending in the left-right direction and having a shorter length than the first rail 1432, and a bearing housing 1436 disposed between the first rail 1432 and the second rail 1434, assembled respectively to the first rail 1432 and the second rail 1434 to be able to move relative to the first rail 1432 and the second rail 1434, and configured to reduce friction respectively with the first rail 1432 and the second rail 1434 on the basis of rolling friction of a bearing when the second rail 1434 moves.

In one embodiment, the first rail 1412 of the top rail 1410 may be fixed onto a back surface of an upper side of an upper panel module 1110 of the door assembly 200, and the second rail 1414 may be fixed to the long-distance fan assembly 400.

In one embodiment, the first rail 1422 of the middle rail 1420 may be fixed onto a back surface of an upper side of a lower panel module 1120 of the door assembly 200, and the second rail 1424 may be fixed to a front surface of an upper side of the fixed plate 190.

In one embodiment, the first rail 1432 of the bottom rail 1430 may be fixed to a back surface of a lower side of the lower panel module 1120 of the door assembly 200, and the second rail 1434 may be fixed to a front surface of a lower side of the fixed plate 190.

When the door assembly 200 is moved in the left-right direction by the door slide module 1300, the second rails 1414, 1424, 1434 may be in place in a state of supporting a load, and the first rails 1412, 1422, 1432 fixed to the door assembly 200 may move in the left-right direction.

The top supporter 1440 may distribute the load of the door assembly 200 to the upper side of the cabinet. The bottom supporter 1450 may support the lower side of the door assembly 200 and may reduce friction that is caused when the door assembly 200 slides in the left-right direction.

The top supporter 1440 may be assembled to the top rail 1410 to support the load of the door assembly 200 even when the door assembly 200 moves.

The top supporter 1440 may include a first fixation part 1441 hung on an upper surface of the cabinet assembly 100 and fixed to the cabinet assembly 100, and a second fixation part 1442 bent and formed from the first fixation part 1441 and disposed to face the back surface of the door assembly 200.

The first fixation part 1441 and the second fixation part 1442 may be bent to be formed, and, in one embodiment, may form a contained angle of 90 degrees. The first fixation part 1441 may be disposed horizontally and the second fixation part 1442 may be disposed perpendicularly.

In one embodiment, the second fixation part 1442 may be disposed to face the back surface of the door assembly 200 and may be fixed to the second rail 1414 of the top rail 1410.

The first fixation part 1441 may include a top laid part 1444 protruding from the second fixation part 1442 towards the cabinet assembly 100 and hung on the cabinet assembly 100, and a top stopping part 1446 disposed at the top laid part 1444 and enabling a mutual lock with the cabinet assembly 100 in a front-rear direction.

The second fixation part 1442 may extend in the left-right direction of the door assembly 200. The second fixation part 1442 may be assembled to the door assembly 200 in close contact with the door assembly 200. In one embodiment, the second fixation part 1442 may be assembled to a structure at the door assembly 200 side, and may be coupled to the second rail 1414.

The second fixation part 1442 may be disposed at a rear of the second rail 1414.

The top laid part 1444 and the second fixation part 1442 may be integrally manufactured. A single plate may be bent to manufacture the second fixation part 1442 and the top laid part 1444.

The top laid part 1444 may protrude rearward from the second fixation part 1442.

In one embodiment, the top laid part 1444 may protrude rearward from an upper edge of the second fixation part 1442.

The top laid part 1444 may be fixed to the upper side of the cabinet assembly 100.

When the door assembly 200 makes left-right movements, the top laid part 1444 and the second rail 1414 may be in place, and the first rail 1412 and the door assembly 200 may make relative movements in the left-right direction.

The top stopping part 1446 may be formed in the left-right direction and may allow a lock in the left-right direction of the cabinet assembly 100.

The top stopping part 1446 may protrude downward from the top laid part 1444.

In one embodiment, the top stopping part 1446 may be shaped into a groove that is concaved towards a lower side and may extend along a lengthwise direction of the top laid part 1444. The top stopping part 1446 may be provided with a stopping part groove 1446*a* being open upward, and the stopping part groove 1446*a* may extend in the left-right direction.

The top laid part 1444 may include a first top laid part 1444*a* disposed at a front with respect to the top stopping part 1446, and a second top laid part 1444*b* disposed at a rear with respect to the top stopping part 1446.

The top stopping part 1446 may be disposed between the first top laid part 1444*a* and the second top laid part 1444*b*.

The top stopping part 1446 may be inserted into the upper side of the cabinet assembly 100 and a top supporter installation part (not illustrated) enabling a mutual lock with the top stopping part 1446 may be disposed at the upper side of the cabinet assembly 100.

The bottom supporter 1450 may be fixed to a structure at the cabinet assembly 100 side, and may be configured to support a lower end of the door assembly 200 and to minimize friction that is caused when the door assembly 200 moves.

In one embodiment, the bottom supporter 1450 may be coupled to the fixed plate 190. The fixed plate 190 may be a structure fixed to the cabinet assembly 100, and, in one embodiment, the door slide module 1300 may be installed at the fixed plate 190.

The bottom supporter 1450 may be coupled to a lower side of the fixed plate 190 and may be inserted and disposed into a supporter groove 131 formed at the base 130. A lower end 1482 of the bottom supporter 1450 may be inserted into the supporter groove 131.

As the lower end 1482 of the bottom supporter 1450 is inserted into the supporter groove 131, the bottom supporter 1450 may be prevented from being exposed out of the door assembly 200. Even when the door assembly 200 operates, the bottom supporter 1450 may not be seen by a user.

The bottom supporter 1450 exposed out of the supporter groove 131 may be hidden by the door assembly 200. The supporter groove 131 may be concaved downward from an upper surface 132 of the base 130. The supporter groove 131 may extend in the left-right direction. The supporter groove 131 may be eccentric to one side (in one embodiment, the left) from the center line (Y).

The bottom supporter 1450 may include a bottom supporter body 1460 disposed between the door assembly 200 and the cabinet assembly 100, disposed in parallel with a back surface of the door assembly 200 and assembled to a structure (in one embodiment, the fixed plate 190) at the cabinet assembly side, a bottom supporter stopping part 1454 disposed at the bottom supporter body 1460 and enabling a mutual lock with the fixed plate 190, a bottom wheel 1456 which is disposed at the bottom supporter body 1460, at which the lower end of the door assembly 200 is hung, which supports the door assembly 200, and which is disposed to move relative to the bottom supporter body 1460, and a sensor installation part 1458 which is disposed at the bottom supporter body 1460 and where a sensor, configured to sense a position of movement of the door assembly 200, is installed.

The bottom supporter body 1460 may include a supporter plate 1470 assembled to a structure (in one embodiment, the fixed plate 190) at the cabinet assembly side, and a supporter body 1480 which is coupled to the supporter plate 1470 and where the bottom wheel 1456 is installed.

In one embodiment, a metallic plate may be bent to manufacture the supporter plate 1470, and a synthetic resin may be injected to manufacture the supporter body 1480.

Unlike the embodiment, the supporter plate 1470 and the supporter body 1480 may all be injection-molded. However, in this case, strength is unavoidably reduced. The bottom supporter 1450 has to withstand a load of the door assembly 200. In case the bottom supporter 1450 is entirely made of a synthetic resin, strength may be reduced, and damage or deflection caused by bending may be done to the bottom supporter 1450.

The door assembly 200 has a structure that slides in the left-right direction instead of being opened as a result of rotation. Accordingly, the bottom supporter 1450 has to support the load of the door assembly 200 all the time.

Additionally, in case the bottom supporter 1450 is entirely made of a metallic material, it is difficult to manufacture an installation structure of the supporter wheel 1456 and an installation structure of the sensor installation part 1458.

In one embodiment, the bottom supporter body 1460 may be disposed at a rear of the fixed plate 190. The bottom supporter body 1460 may be coupled and fixed to a back surface of the fixed plate 190.

The supporter plate 1470 may include a supporter plate body 1472 brought into close contact with the fixed plate 190 that is a structure of the cabinet assembly side, a bottom supporter stopping part 1454 formed at the supporter plate body 1472, bent towards the fixed plate 190 and enabling a mutual lock with the fixed plate 190 with respect to the left-right direction, and a supporter body installation part 1474 where the supporter body 1480 formed at the supporter plate body 1472 is installed.

The supporter plate 1470 may be disposed in parallel with the fixed plate 190 and may be coupled to the fixed plate 190. The supporter plate 1470 may be provided with a plurality of coupling holes 1471 for a coupling with the fixed plate 190.

In one embodiment, the supporter plate 1470 may be provided with the bottom supporter stopping part 1454. The supporter plate 1470 may be bent to form the bottom supporter stopping part 1454.

In one embodiment, the bottom supporter stopping part 1454 may closely contact a left surface and a right surface of the fixed plate 190. The bottom supporter stopping part 1454 may be bent towards the fixed plate 190. The bottom supporter stopping part 1454 may be disposed in the up-down direction, and enables a mutual lock with the fixed plate 190 with respect to the left-right direction. Unlike the embodiment, the bottom supporter stopping part 1454 may be formed at the supporter body 1480.

The fixed plate 190 may be provided with a fixed plate insertion part 191 into which the bottom supporter body 1460 is fitted.

The fixed plate insertion part 191 may be bent and formed rearward from the fixed plate 190. For the fixed plate insertion part 191, an upper surface may be closed, and a lower side and left and right sides may be open. A gap 192 may be formed between the fixed plate insertion part 191 and a back surface of the fixed plate 190.

Accordingly, the bottom supporter body 1460 may be inserted from a lower side of the fixed plate insertion part 191. In one embodiment, an upper end of the bottom supporter body 1460 may be inserted into the gap 192, and the fixed plate insertion part 191 may limit an upward movement of the bottom supporter body 1460.

When the bottom supporter body 1460 is assembled to the fixed plate 190, the fixed plate insertion part 191 and the bottom supporter stopping part 1454 may limit an installation position of the bottom supporter body 1460. Accordingly, when the bottom supporter body 1460 is inserted into the fixed plate insertion part 191, each coupling hole 1471 formed at the fixed plate 190 and the bottom supporter body 1460 may be aligned to be able to be coupled.

The supporter plate body 1472 may be bent to manufacture the supporter body installation part 1474. The supporter body 1480 may be assembled to the supporter body installation part 1474.

The supporter body installation part 1474 may be bent rearward from the supporter plate body 1472 and may ensure a space for installation of the supporter body 1480.

The supporter body 1480 may be disposed further rearward than the door assembly 200, and the bottom wheel 1456 may be disposed at a lower side of the door assembly 200, for example.

The supporter body 1480 may be provided with at least two bottom wheels 1456. To this end, the supporter body 1480 may be long in the left-right direction, and the bottom wheel 1456 may be arranged in the left-right direction.

Additionally, a plurality of top wheels 1459 may be disposed at an upper side of the fixed plate 190. The top wheel 1459 may support the panel module 1100 configured to move in the left-right direction (in one embodiment, a lower panel module 1120). The top wheel 1459 and the bottom wheel 1456 may distribute the load of the door assembly 200. The top wheel 1459 and the bottom wheel 1456 may reduce a load of the side moving assembly 1400.

The supporter body 1480 may include a rail insertion part 1486 which is concaved rearward and into which a lower end rail 206 of the door assembly 200 is inserted, and a rotation axis hole 1481 into which a wheel shaft 1483 of the bottom wheel 1456 is inserted.

The rail insertion part 1486 may be formed in the left-right direction. The rail insertion part 1486 may be disposed further rearward than the bottom wheel 1456. When seen from a front, an upper end of the bottom wheel 1456 may overlap with the rail insertion part 1486.

The upper end of the bottom wheel 1456 may be lower than an upper end 1486*a* of the rail insertion part 1486 and higher than a lower end 1486*b* of the rail insertion part 1486.

The rotation axis hole 1481 may be lower than the lower end 1486*b* of the rail insertion part 1486.

The lower end rail 206 of the door assembly 206 may be inserted into the rail insertion part 1486 and may be supported by the upper end of the bottom wheel 1456. With the structure, a gap between the door assembly 200 and the bottom supporter 1450 may be minimized.

When a front-rear gap between the door assembly 200 and the bottom supporter 1450 becomes wider, a load applied to the bottom supporter 1450 may increase.

In one embodiment, the front-rear gap between the door assembly 200 and the bottom supporter 1450 may be minimized. Accordingly, a load applied to the bottom wheel may be minimized, and a load applied to the bottom supporter 1450 may also be minimized.

When viewed from a front, the bottom wheel 1456 may be shaped in a circle, and may be provided with a wheel groove 1456*a* along an outer circumferential surface thereof. The lower end rail 206 may be held in the wheel groove 1456*a*.

A rotating shaft 1457, disposed at the bottom wheel 1456 and protruding in the front-rear direction, may be further included. In one embodiment, the rotating shaft 1457 may protrude rearward from the bottom wheel 1456. The rotating shaft 1457 and the bottom wheel 1456 may be integrally manufactured.

The wheel shaft 1483 may pass through the rotating shaft 1457. The bottom wheel 1456 may rotate in a state of being assembled to the wheel shaft 1483. The wheel shaft 1483 may pass through the bottom wheel 1456 and the rotating shaft 1457 and then the rotation axis hole 1481 of the supporter body 1480 to be installed.

A shaft fixation member 1485 coupled to the wheel shaft 1483 may be disposed at a rear of the supporter body 1480. The supporter body 1480 may include a shaft fixation member groove 1484 that is concaved from a rear to a front.

The wheel shaft 1483 may pass through the supporter body 1480 to be fixed to the shaft fixation member 1485, and the bottom wheel 1456 may rotate in a state of being penetrated by the wheel shaft 1483.

The sensor installation part 1458 may be disposed at the supporter body 1480, and in one embodiment, may be formed to pass through the supporter body 1480. A door sensor 207 may be disposed at the sensor installation part 1458.

The door sensor 207 may sense a sliding distance of the door assembly 200. A position sensing element 208 may be disposed at the door assembly 200.

The position sensing element 208 may correspond to the door sensor 207. The position sensing element 208 may be disposed on a back surface of the door assembly 200, and specifically, may be disposed on a back surface of the lower panel module 1120.

In one embodiment, a Hall sensor and a permanent magnet may be used to sense a distance moved by the door assembly 200 in the left-right direction. A Hall sensor may be used as the door sensor 207, and a permanent magnet may be used as the position sensing element 208.

Two door sensors 207 may be disposed at the cabinet assembly 100 side. A single position sensing element 208 may be disposed at the door assembly 200 side.

The plurality of door sensors 207 may be disposed in a transverse direction. One may be disposed at a left edge of the cabinet assembly 100 and the other may be disposed on a left side of the center line (Y).

The door sensor disposed on the left side of the center line (Y) is referred to as a first door sensor 207-1 and the door sensor disposed at the edge of the cabinet assembly 100 is referred as a second door sensor 207-2.

In case the first door sensor 207-1 senses the position sensing element 208, it may be determined that the door assembly 200 is closed. In case the second door sensor 207-2 senses the position sensing element 208, it may be determined that the door assembly 200 is opened.

Unlike the embodiment, a photo sensor may be used as the door sensor, and a rib disposed at the door assembly may be used as the position sensing element. In case the rib blocks an optical signal of the photo sensor, a distance moved by the door assembly in the left-right direction may be determined.

In one embodiment, the door assembly 200 may move 140 mm. When the door assembly 200 slides, the left side of the door assembly 200 may protrude out of a left surface of the cabinet assembly 100 by 140 mm. Although the door assembly 200 slides, the center line (Y) of the door assembly 200 may be placed within a width of the cabinet assembly 100.

When the door assembly 200 slides, the center line (Y) with respect to a left-right width of the door assembly 200 may be disposed within a left-right width (W2) of the fixed plate 190. In one embodiment, the center line (Y) may be placed at a center of the left-right width (W2) of the fixed plate 190.

A center line (X) of the fixed plate 190 may be a virtual line that is disposed at a center with respect to the left-right width (W2) and that extends in the up-down direction.

When the door assembly 200 slides, the center line (Y) of the door assembly 200 may be aligned with the center line (X) of the fixed plate 190.

Since the middle rail 1420 and the bottom rail 1430 are coupled to the fixed plate 190, the fixed plate 190 may support the load of the door assembly 200 through the middle rail 1420 and the bottom rail 1430.

When the center line (Y) is placed on the center line (X) of the fixed plate 190 as a result of a sliding movement of the door assembly 200, a left-right eccentricity caused by the door assembly 200 may be minimized.

<<Configuration of Camera Module>>

The camera module 1900 may be disposed at the door assembly 200 (in one embodiment, an upper panel module 1110) and may optionally operate. The camera module 1900 may be exposed out of the door assembly 200 when operating, and may be hidden in the door assembly 200 when not operating.

The camera module 1900 may include a camera module housing 1910 disposed at the door assembly 200 and provided with a camera opening 1911 being open upward, a camera 1950 disposed in the camera module housing 1910, moving in an up-down direction with respect to the camera module housing 1910 and being optionally exposed through the camera opening 1911, a camera body 1920 which is disposed in the camera module housing 1910 and where the camera 1950 is disposed, a camera controller 1930 disposed at the camera body 1920, electrically connected to the camera 1950 and configured to control the camera 1950, and a camera moving module 1960 disposed in the camera module housing 1910 and configured to move the camera body 1920, where the camera 1950 is installed, in the up-down direction.

The camera module housing 1910 may be a part of the upper panel module 1110. In one embodiment, the camera module housing 1910 and the upper panel module 1110 may be separately manufactured, and the camera module housing 1910 may be disposed at an upper side of the upper panel module 1110.

The camera module housing 1910 may cover the panel upper opening 203. A top wall 1912 of the camera module housing 1910 may be disposed inside the front panel 210 and may block the panel upper opening 203.

The camera opening 1911 may be formed at the top wall 1912 of the camera module housing 1910. The camera opening 1911 may pass through the top wall 1912 of the camera module housing 1910 in the up-down direction.

The camera module housing 1910 may include the housing top wall 1912 including the camera opening 1911 and forming an upper surface of the door assembly 200, a housing left wall 1913 extending downward from the housing top wall 1912 and coming into close contact with a left surface of the front panel 210, a housing right wall 1914 extending downward from the housing top wall 1912 and coming into close contact with a right surface of the front panel 210, and a housing inner wall 1915 extending downward from the housing top wall 1912 and connecting the housing left wall 1913 and the housing right wall 1914.

The housing left wall 1913 may closely contact an inner surface of a first front panel side 214 of the front panel 210. The housing right wall 1914 may closely contact an inner surface of a second front panel side 216 of the front panel 210.

The housing left wall 1913 and the housing right wall 1914 may be disposed in a front-rear direction. The housing left wall 1913 and the housing right wall 1914 may be disposed to face each other.

The housing inner wall 1915 may be disposed in a left-right direction and may be disposed at an upper side of the door cover assembly 1200. In one embodiment, the housing inner wall 1915 may be disposed at an upper side of a door cover top wall 1114.

That is, with respect to the door cover top wall 1114 of the upper panel module 1110, the housing inner wall 1915 may be disposed at an upper side and a door cover housing 1220 may be disposed at a lower side.

A lower end of the housing inner wall 1915 may have a shape corresponding to that of the door cover top wall 1114.

When viewed from a front, the door cover top wall 1114 may be shaped into an arc having a predetermined radius of curvature. Accordingly, when viewed from the front, the lower end 1916 of the housing inner wall 1915 may also be shaped into an arc having a predetermined radius of curvature.

Since the lower end 1916 of the housing inner wall 1915 has an arc shape that is concaved upward, a space for installation of the camera module housing 1910 may be minimized.

The camera body 1920 may be installed in the camera module housing 1910.

The camera body 1920 may be disposed at a front or at a rear of the camera module housing 1910. The camera body 1920 may be moved in the up-down direction by the camera moving module 1960.

The camera 1950 may be installed at the camera body 1920. In one embodiment, an upper end of the camera 1950 may be placed higher than an upper end of the camera body 1920.

When the camera moving module 1960 operates, the camera body 1920 may be placed at a lower side of the top wall 1912, and the camera 1950 may be exposed out of the top wall 1912.

The upper end 1921 of the camera body 1920 may closely contact a bottom surface of the top wall 1912, and the top wall 1912 may serve as a stopper that limits an upward movement of the camera body 1920.

The camera body 1920 may include a camera controller installation part 1922 where the camera controller 1930 is installed.

A virtual central axis (C), connecting a center of a front discharge port 201 formed at the front panel 210 and a center of a display opening 202, may be disposed perpendicularly.

The camera 1950 of the camera module 1900 may be disposed on the central axis (C).

The camera controller installation part 1922 may be eccentric to a left side or a right side from the central axis (C).

Like the lower end 1916 of the housing inner wall 1915, a lower end 1926 of the camera body 1920 may be shaped into an arc having a predetermined radius of curvature, when seen from the front.

Since the lower end 1926 of the camera body 1920 is shaped into an arc that is concaved upward, the lower end 1926 of the camera body 1920 may prevent interference between the camera body 1920 and the door cover top wall 1114 when the door cover assembly 1200 moves in the up-down direction.

In one embodiment, a radius of curvature of the lower end 1926 of the camera body 1920 may be the same as that of the lower end 1916 of the housing inner wall 1915.

When moving downward, the camera body 1920 may be supported by the door cover top wall 1114 and its movement may be limited. The door cover top wall 1114 may serve as a stopper that limits movement of the camera body 1920.

The camera 1950 may be disposed at the camera body 1920 and may protrude from an upper side of the camera body 1920. The camera 1950 may move in the up-down direction on the basis of operation of the camera moving module 1960, and may pass through the camera opening 1911 to be exposed out of the door assembly 200.

When the camera 1950 is not used, the camera 1950 may move to a lower side of the camera opening 1911 and may be hidden from sight of a user.

The camera opening 1911 and the camera 1950 may be placed on the central axis (C) and may move in a direction of the central axis (C).

An upper surface 1951 of the camera 1950 may cover the camera opening 1911. When the camera 1950 does not operate, the upper surface 1951 of the camera 1950 may form a continuous flat surface along with an upper surface (in one embodiment, the top wall 1912) of the camera module housing 1910.

The camera moving module 1960 is a component for moving the camera body 1920 in the up-down direction.

The camera moving module 1960 may include a camera moving rack 1962 disposed at the camera body 1920 and extending in a direction of movement of the camera 1950, a camera gear 1964 engaged with the camera rack 1962, and a camera moving motor 1966 disposed at a structure fixed to the door assembly 200 and configured to supply a rotational force to the camera moving gear 1964.

The camera moving rack 1962 may include a plurality of teeth, and each tooth may be arranged in the up-down direction. The camera moving rack 1962 may extend in the up-down direction.

In one embodiment, the camera gear 1964 may be a pinion gear. The camera gear 1964 may be coupled to a motor shaft 1967 of the camera moving motor 1966.

When the camera moving motor 1966 operates, the camera gear 1964 may rotate in place, and the camera moving rack 1962 may move in the up-down direction in a state of being engaged with the camera gear 1964.

In one embodiment, the camera moving rack 1962 may be disposed respectively on a left side and a right side the central axis (C) to raise a left side and a right side of the camera body 1920 uniformly.

The camera moving rack 1962 on the left side of the central axis (C) is referred to as a first camera moving rack 1962*a*, and the camera moving rack 1962 on the right side of the central axis (C) is referred to as a second camera moving rack 1962*b*. The first camera moving rack 1962*a* and the second camera moving rack 1962*b* have the same configuration while being disposed at different positions. Accordingly, they may be given the same reference numeral.

The camera moving gear 1964 on the left side of the central axis (C) is referred to as a first camera moving gear 1964*a*, and the camera moving gear 1964 on the right side of the central axis (C) is referred to as a second camera moving gear 1964*b*. The first camera moving gear 1964*a* and the second camera moving gear 1964*b* have the same configuration while being disposed at different positions. Accordingly, they may be given the same reference numeral.

Axes of rotation of the first camera moving gear 1964*a* and the second camera moving gear 1964*b* may be disposed in the left direction.

In one embodiment, a single camera moving motor 1966 may be used to rotate the first camera moving gear 1964*a* and the second camera moving gear 1964*b*. To this end, a moving gear shaft 1965, where the first camera moving gear 1964*a* and the second camera moving gear 1964*b* are combined, may be disposed.

The first camera moving gear 1964*a* may be assembled to a left side of the moving gear shaft 1965, and the second camera moving gear 1964*b* may be assembled to a right side of the moving gear shaft 1965.

The moving gear shaft 1965 may be disposed horizontally. In one embodiment, an axis of rotation of the moving gear shaft 1965 and the motor shaft 1967 of the camera moving motor 1966 may be arranged in a line.

The camera moving motor 1966 may be installed at a fixed structure at the cabinet assembly 100 side. In one embodiment, the camera moving motor 1966 may be fixed to the camera module housing 1910. Unlike the embodiment, the camera moving motor 1966 may be fixed to a structure such as the upper panel module 1110 or the front panel 210 and the like constituting the door assembly 200.

Additionally, unlike the embodiment, the positions of the camera moving motor 1966 and the camera moving rack 1962 may be exchanged.

To uniformly raise both ends of the camera body 1920 being long and disposed in the left-right direction, the first camera moving rack 1962*a* and the second camera moving rack 1962*b* may be symmetrical in the left-right direction with respect to the central axis (C). Further, the first camera moving gear 1964*a* and the second camera moving gear 1964*b* may be symmetrical in the left-right direction with respect to the central axis (C).

Although the embodiments have been described with reference to a number of illustrative embodiments thereof, it should be understood that numerous other modifications and embodiments can be devised by those skilled in the art. In addition to variations and modifications in the component parts and/or arrangements, alternative uses will also be apparent to those skilled in the art. Thus, it should be understood that the embodiments are provided only as examples and are not limited.

The invention claimed is:

1. An indoor unit of an air conditioner, comprising:

a cabinet assembly;

a door assembly disposed at a front of the cabinet assembly to cover the front of the cabinet assembly;

a fixed plate fixed to the cabinet assembly and disposed between the door assembly and the cabinet assembly; and a door assembly moving part disposed between the door assembly and the fixed plate to move the door assembly in a left-right direction with respect to the cabinet assembly, wherein when seen from the front of the cabinet assembly, the fixed plate is fixed eccentric in a direction where the door assembly moves such that when the door assembly moves, a center line of the door assembly remains within a left-right width of the fixed plate.

2. The indoor unit of claim 1, wherein the left-right width of the fixed plate is less than half of a left-right width of the door assembly.

3. The indoor unit of claim 2, wherein the indoor unit comprises a detachable water tank and further comprises a humidification assembly to supply moisture to be discharged to an indoor space, the cabinet assembly comprises a cover where a water tank opening for mounting or dismounting the water tank and an open surface for repairs or replacement of the humidification assembly are formed, while blocking at least part of the front of the cabinet assembly, and the center line of the door assembly is disposed in a middle of the left-right width of the fixed plate when the door assembly is moved such that the water tank opening is exposed and the open surface is not exposed at the front of the cabinet assembly.

4. The indoor unit of claim 2, wherein the fixed plate is fixed to the cabinet assembly such that a center of the left-right width of the fixed plate is disposed towards a direction where the door assembly moves with respect to a center of the left-right width of the door assembly from a state in which the door assembly closes the front of the cabinet assembly.

5. The indoor unit of claim 4, wherein the door assembly moving part comprises:

a first rail extending in a left-right direction;

a second rail extending in the left-right direction and having a shorter length than the first rail; and a bearing housing disposed between the first rail and the second rail, assembled respectively to the first rail and the second rail to be able to move relative to the first rail and the second rail, and to reduce friction, which is caused when the bearing housing moves relative to the first rail and the second rail, based on rolling friction, wherein the second rail is fixed onto the fixed plate, and the first rail is fixed to the door assembly.

6. The indoor unit of claim 5, wherein the second rail has a length the same as the left-right width of the fixed plate or shorter than the left-right width of the fixed plate.

7. The indoor unit of claim 1, wherein the door assembly moving part comprises:

a bottom rail disposed between a lower side of the door assembly and a lower side of the fixed plate to guide a left-right movement of the door assembly; and a middle rail disposed between a middle of the door assembly and an upper side of the fixed plate to guide a left-right movement of the door assembly.

8. The indoor unit of claim 1, further comprising:

a top rail disposed between an upper side of the door assembly and an upper side of the cabinet assembly to guide a left-right movement of the door assembly; and a top supporter disposed on an upper surface of the cabinet assembly, fixed to the cabinet assembly and provided with the top rail, the top rail comprising:

a first rail extending in a left-right direction;

a second rail extending in the left-right direction and having a shorter length than the first rail; and a bearing housing disposed between the first rail and the second rail, assembled respectively to the first rail and the second rail to be able to move relative to the first rail and the second rail, and to reduce friction, which is caused when the bearing housing moves relative to the first rail and the second rail, based on rolling friction, the top supporter comprising:

a first fixation part disposed on an upper surface of the cabinet assembly and fixed to the cabinet assembly; and a second fixation part bent and formed from the first fixation part and facing a back surface of the door assembly, wherein the first rail is fixed onto the back surface of the door assembly, and the second rail is disposed at a rear of the first rail and is fixed to the second fixation part.

9. The indoor unit of claim 1, further comprising:

a bottom supporter disposed at a rear of the door assembly, which is fixed onto the fixed plate, and at which a lower end of the door assembly is hung, the bottom supporter, comprising:

a bottom supporter body assembled to the fixed plate; and a bottom wheel rotatably assembled to the bottom supporter body, supporting the door assembly and rotatable when the door assembly moves.

10. The indoor unit of claim 9, wherein the bottom supporter body comprises:

a supporter plate assembled to the fixed plate and disposed at a rear of the door assembly; and a supporter body coupled to the supporter plate and where the bottom wheel is rotatably installed, wherein the bottom wheel is disposed further downward than the door assembly and supports a lower end of the door assembly.

11. The indoor unit of claim 10, wherein the cabinet assembly further comprises a base disposed further downward than a lower end of the door assembly, the base comprises a supporter groove that is concaved from an upper side to a lower side, and a lower end of the supporter body is inserted into the supporter groove.

12. The indoor unit of claim 1, wherein the door assembly moving part further comprises:

a rack disposed at the door assembly and extending in a left-right direction;

a gear assembly disposed at the fixed plate, engaged with the rack and to move the rack when rotating; and a gear driving motor disposed at the fixed plate to supply a driving force to the gear assembly.

13. The indoor unit of claim 12, wherein the door assembly moving part further comprises a middle rail disposed between a middle of the door assembly and the fixed plate to guide the left-right movement of the door assembly, and the rack is disposed along a side of the middle rail in a left-right direction, and the gear assembly is disposed at a side of the rack.

14. The indoor unit of claim 13, wherein the middle rail comprises:

a first rail extending in a left-right direction;

a second rail extending in the left-right direction and having a shorter length than the first rail; and a bearing housing disposed between the first rail and the second rail, assembled respectively to the first rail and the second rail to be able to move relative to the first rail and the second rail, and to reduce friction, which is caused when the bearing housing moves relative to the first rail and the second rail, based on rolling friction, wherein the first rail is fixed to the middle of the door assembly, the second rail is fixed onto the fixed plate, and the rack protrudes from a side of the first rail.

15. The indoor unit of claim 12, wherein the gear assembly comprises a worm gear coupled to the gear driving motor and rotatable, and a motor shaft of the gear driving motor couples to the worm gear.

16. The indoor unit of claim 15, wherein the motor shaft of the gear driving motor forms a contained angle with respect to a horizontal direction, and the contained angle is between 0 degree and 90 degree with respect to the horizontal direction.

17. The indoor unit of claim 12, wherein the gear assembly comprises:

a first gear disposed at the fixed plate, provided with a first teeth part on an outer circumferential surface thereof, and engaged with the rack through the first teeth part;

a second gear comprising a 2-1 teeth part and a 2-2 teeth part having different radii of curvature and engaged with the first teeth part of the first gear through the 2-1 teeth part;

a third gear comprising a 3-1 teeth part and a 3-2 teeth part having different types of teeth and engaged with the 2-2 teeth part of the second gear through the 3-1 teeth part; and a worm gear engaged with the 3-2 teeth part and coupled to the gear driving motor to rotate.

18. The indoor unit of claim 17, wherein the motor shaft of the gear driving motor is coupled to the worm gear, and the motor shaft of the gear driving motor forms a contained angle with respect to a horizontal direction, and the contained angle is between 0 degree and 90 degree with respect to the horizontal direction.

19. The indoor unit of claim 17, wherein the door assembly moving part further comprises;

a gear housing fixed onto the fixed plate and where the first gear, the second gear, the third gear, the worm gear and the gear driving motor are stored.

20. The indoor unit of claim 19, wherein a portion of the first gear protrudes out of the gear housing and the protruding portion of the first gear is engaged with the rack.

* * * * *